US007014985B2

(12) United States Patent
Kikuchi

(10) Patent No.: US 7,014,985 B2
(45) **Date of Patent: *Mar. 21, 2006**

(54) PRESENSITIZED PLATE

(75) Inventor: Kei Kikuchi, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/386,560

(22) Filed: Mar. 13, 2003

(65) Prior Publication Data

US 2003/0194642 A1 Oct. 16, 2003

(30) Foreign Application Priority Data

Mar. 13, 2002 (JP) ..... 2002-068046

(51) Int. Cl.

| | |
|---|---|
| ***G03F 7/038*** | (2006.01) |
| ***G03F 7/031*** | (2006.01) |
| ***G03F 7/09*** | (2006.01) |
| ***B41N 1/00*** | (2006.01) |
| ***B41N 3/00*** | (2006.01) |

(52) U.S. Cl. ..... 430/278.1; 430/964; 101/456; 101/459

(58) Field of Classification Search ..... 430/270.1, 430/278.1, 281.1, 286.1, 287.1, 288.1, 302, 430/964; 101/456, 459

See application file for complete search history.

(56) References Cited

U.S. PATENT DOCUMENTS

| | | | | |
|---|---|---|---|---|
| 5,837,345 | A | 11/1998 | Nishino et al. | |
| 6,716,567 | B1 * | 4/2004 | Endo et al. | 430/278.1 |
| 2001/0031423 | A1 | 10/2001 | Kita | |
| 2002/0086238 | A1 | 7/2002 | Fujimake et al. | |
| 2003/0165768 | A1 * | 9/2003 | Hotta | 430/146 |
| 2003/0165775 | A1 * | 9/2003 | Endo et al. | 430/278.1 |
| 2004/0063033 | A1 * | 4/2004 | Hotta | 430/278.1 |

FOREIGN PATENT DOCUMENTS

| | | | |
|---|---|---|---|
| EP | 1 273 439 A2 | * | 1/2003 |
| EP | 1 300 257 A2 | * | 4/2003 |
| JP | 8-258440 A | | 10/1996 |
| JP | 8-300843 A | | 11/1996 |
| JP | 11-099758 | * | 4/1999 |
| JP | 11-167204 A | | 6/1999 |
| JP | 11-167207 | * | 6/1999 |
| JP | 11-208138 | * | 8/1999 |
| JP | 2001-183816 A | | 7/2001 |
| JP | 2001-312062 A | | 11/2001 |

* cited by examiner

*Primary Examiner*—Richard L. Schilling
(74) *Attorney, Agent, or Firm*—Sughrue Mion, PLLC

(57) ABSTRACT

A thermal negative type presensitized plate provided with an image recording layer hardened by infrared rays on an aluminum support, wherein the aluminum support has on the surface thereof, a grain shape with a structure in which a grained structure with medium undulation with a specified aperture diameter and a grained structure with small undulation with a specified aperture diameter are superimposed. For the presensitized plate, contact characteristics between the image recording layer and the support and scum resistance on a non-image area are kept compatible with each other at a high level, a thermal diffusion depression effect by which an energy generated by exposure can be efficiently used to form an image is excellent, and sensitivity is high.

4 Claims, 3 Drawing Sheets

PRESENSITIZED PLATE

BACKGROUND OF THE INVENTION

1. Field of the Invention

The present invention relates to a support suitable for a lithographic printing plate having a photosensitive and/or thermosensitive image recording layer and a presensitized plate using the support for a lithographic printing plate. More particularly, the present invention relates to a support for a lithographic printing plate suitable for the formation of a thermal negative type recording layer and a presensitized plate using the support for a lithographic printing plate.

2. Description of the Related Art

In recent years, with the development of an imaging technology, attention has been drawn to a direct plate making technology where a narrowed laser beam is scanned on a printing plate to directly form a character manuscript, an image manuscript or the like on the printing plate without using a film manuscript.

In a so-called thermal negative type lithographic printing plate where a photothermal conversion takes place in a recording layer and a negative image is formed by lowering an alkali-solubility of the recording layer by heat generated, which is the representative aspect of the direct plate making technology, since heat is generated by photothermal conversion agents such as infrared absorbent in the recording layer by irradiating a laser beam and an image formation reaction is triggered by heat, the following problems occur if an image formation reaction by heat is not sufficient.

On an aluminum support on which graining is performed and an anodized layer is formed, heat generated in the vicinity of an interface between the support and the recording layer transfers to inside the support before an image formation reaction sufficiently progresses, since the thermal conductivity of the support is significantly higher than that of the recording layer. Then, since the hardening reactivity of the recording layer particularly at the interface between the support and the recording layer is not sufficient, the contact characteristics of an image area with the support is not sufficient, thus press life occasionally deteriorates.

In addition, if the sensitivity of a solution shown by the conductivity of a developer becomes high, even the image area obtained after hardening reaction, which is hardly melted by nature, is melted. Thus, an inadequate inking may occur and the deterioration of press life may be caused by the problem of the insufficient hardening reaction of the recording layer at the interface. This phenomenon is attributable to the image formation mechanism of the thermal negative type and it is considered that the phenomenon is caused by the hardening reaction mechanism of the recording layer at the time of heating, particularly the insufficiency of the hardening reaction in the vicinity of the interface between the support and a recording layer.

As a means to solve these problems, it is general to perform heat treatment after exposure in order to accelerate hardening reaction at the exposure area of the recording layer. However, since special equipment is required and the process is complicated, it is the status quo that the industry hopes to have a negative type lithographic printing plate capable of forming a better image dispensing with performing a post-heat treatment like this.

Furthermore, in the thermal negative type recording layer where an image is formed by a laser exposure, the following problems exist.

Since the surface of the support is exposed and becomes a hydrophilic area when the unhardened recording layer of a non-exposed area (a non-image area) is removed by a developer, scum tends to develop easily at the non-image area due to the attachment of an undesired ink-receptive ink at the time of printing if hydrophilicity of the support surface is not adequate. Although as a countermeasure to this problem, silicate treatment or the like is performed on the surface of the support after anodizing treatment is performed thereon for the purpose of enhancing the hydrophilicity, a further improvement is required.

In addition, there is also a problem that if a developer exhausts and the sensitivity of the solution shown by the conductivity lowers, the solubility of the recording layer deteriorates and a residual layer is generated, and scum tends to develop easily at the non-image area.

As the means to solve these problems, for example, various undercoating treatments and the like are reviewed. However, each trial cannot reach a sufficiently satisfactory level.

On the other hand, as a recent market trend, users have a strong demand that they would like to use equipment at the lowest possible output power or the like, since the time of exposure is to be shortened in order to enhance productivity and to extend the service life of a laser more. Users strongly seek for a high-sensitivity thermal negative type presensitized plate capable of efficiently using the energy of a laser beam for an image formation reaction, even if the energy of the laser beam is lowered.

SUMMARY OF THE INVENTION

Contact characteristics between an image recording layer and a support, and a scum resistance of a non-image area are in a trade-off relation. Therefore, there is not still a presensitized plate materialized where the contact characteristics and the scum resistance can be kept compatible with each other at a high level, the energy generated by exposure can be efficiently used to form an image and the sensitivity is excellent. Also, a support for a lithographic printing plate used for such presensitized plate has not yet been materialized neither.

The present invention aims to solve at least one problem out of the problems of the above related arts.

Particularly, the present invention aims to provide a high-sensitivity thermal negative type presensitized plate and a support for a lithographic printing plate used for the presensitized plate where the contact characteristics between the image recording layer and the support and the scum resistance on the non-image area are kept compatible with each other at a high level, and a thermal diffusion depression effect by which energy generated by exposure can be efficiently used to form an image is excellent.

In addition, in the present invention, the contact characteristics between the image recording layer and the support is excellent and the sensitivity can be improved since the hardening reaction of the image recording layer adequately progresses by increasing the thermal diffusion depression effect. Furthermore, the scum resistance of the non-image area can be improved by the hydrophilicity of the support surface.

The inventors have thought that the contact characteristics between the image recording layer and the support, and the improvement of the sensitivity can be achieved by improving the efficiency of the image formation reaction by heat generated from the photothermal conversion agents such as infrared absorbents. More concretely, the inventors have thought that the contact characteristics and the improvement of the sensitivity can be achieved by improving "the thermal diffusion depression effect by which the energy generated by exposure can be efficiently used to form an image". Consequently, the inventors have found that the thermal diffusion depression effect can be increased by variously reviewing ways to set the structure of profile irregularities on the surface of the support for a lithographic printing plate at a specified shape.

The inventors have also found that the structure of the profile irregularities on the surface of the support for a lithographic printing plate affects hydrophilicity of the support surface and the sensitivity of the presensitized plate.

The inventors have intently reviewed the sizes and combinations of the structure of the profile irregularities on the surface of the support for a lithographic printing plate. Then they have finally found that by combining the profile irregularities of the specified sizes on an aluminum support, the presensitized plate provided with the image recording layer on the support is of such a fact that the contact characteristics between the image recording layer and the support and the scum resistance of the non-image area can be kept compatible with each other at a high level, has high thermal diffusion depression effect by which the energy generated by exposure can be efficiently used to form the image, and is high in sensitivity. Thus, the present invention is completed.

Namely, the present invention provides the following (1) to (6).

(1) A support for a lithographic printing plate having, on the surface thereof, a grain shape in a structure in which a grained structure with medium undulation of 0.5 to 5 μm average aperture diameter and a grained structure with small undulation of 0.01 to 0.2 μm average aperture diameter are superimposed.

(2) A support for a lithographic printing plate having, on the surface thereof, a grain shape in a structure in which a grained structure with large undulation of 5 to 100 μm average wavelength, a grained structure with medium undulation of 0.5 to 5 μm average aperture diameter and a grained structure with small undulation of 0.01 to 0.2 μm average aperture diameter are superimposed.

(3) The support for a lithographic printing plate according to (1) or (2) mentioned above, in which an average of ratios of depths to the aperture diameters of the aforementioned grained structure with small undulation is 0.15 or more.

It is preferred here that the average of ratios of depths to the aperture diameters of the aforementioned grained structure with small undulation is 0.2 or more.

(4) The support for a lithographic printing plate having, on the surface thereof, a grain shape according to any one of (1) to (3) mentioned above, wherein a thermal diffusion is suppressed.

(5) A presensitized plate provided, on an aluminum support according to any one of (1) to (4) mentioned above, with an image recording layer that is hardened by infrared rays.

(5-1) More specifically, a presensitized plate provided, on an aluminum support, with an image recording layer which is hardened by infrared rays, and the aluminum support having on the surface thereof, a grain shape in a structure in which a grained structure with medium undulation of 0.5 to 5 μm average aperture diameter and a grained structure with small undulation of 0.01 to 0.2 μm average aperture diameter are superimposed.

(5-2) A presensitized plate provided, on an aluminum support, with an image recording layer which is hardened by infrared rays, and the aluminum support having on the surface thereof, a grain shape in a structure in which a grained structure with large undulation of 5 to 100 μm average wavelength, a grained structure with medium undulation of 0.5 to 5 μm average aperture diameter and a grained structure with small undulation of 0.01 to 0.2 μm average aperture diameter are superimposed.

(5-3) A presensitized plate according to (5-1) or (5-2) mentioned above, in which an average of ratios of depths to the aperture diameters of the aforementioned grained structure with small undulation is 0.15 or more.

(5-4) A presensitized plate provided, on an aluminum support, with an image recording layer which is hardened by infrared rays, and the aluminum support having on the surface thereof, a grain shape according to any one of (1) to (3) mentioned above, wherein a thermal diffusion is suppressed.

(6) The presensitized plate according to any one of (5-1) to (5-4) characterized in that the image recording layer hardened by infrared rays is a photopolymerizable-type layer containing an infrared absorbent, a compound generating radicals by heating, and a radical polymerizable compound, or an acid cross-linkable-type layer containing an infrared absorbent, a compound generating acid by irradiating light or heating, and a cross-linking agent acting in the presence of an acid.

The object of the present invention can be achieved by the support for a lithographic printing plate and the presensitized plate.

Concretely, the present invention aims to provide a high-sensitivity thermal negative type presensitized plate and a support for a lithographic printing plate used for the presensitized plate where the contact characteristics between the image recording layer and the support and the scum resistance on the non-image area are kept compatible with each other at a high level, and a thermal diffusion depression effect by which energy generated by exposure can be efficiently used to form an image is excellent.

According to the present invention, since a stronger anchoring effect can be obtained by combining profile irregularities of specified sizes on the surface of the support for a lithographic printing plate, the contact characteristics between the support for a lithographic printing plate and the image recording layer is excellent, and since the surface (the structure of the profile irregularities) of the support becomes even, the hydrophilicity is also excellent.

In addition, since the thermal diffusion depression effect is improved by combining profile irregularities of specified sizes on the surface of the support for a lithographic printing plate, the hardening reaction adequately progresses to enable an even image formation, leading to the improvement in the contact characteristics between the image recording layer and the support and the sensitivity.

The reason why the thermal diffusion depression effect is improved by providing the structure of the profile irregularities (graining) according to the present invention on the surface of the support is unknown. However, it is considered that one of the factors by which the thermal diffusion depression effect is improved is that the thickness of a recording layer applied on the support can be made even and the partial formation of thicker areas of the recording layer where heat is difficult to generate by the absorption of a laser beam can be prevented.

In addition, it is general that a thinner thermosensitive layer is provided to improve the sensitivity or the like and it is also general that graining treatment is performed on the support for a lithographic printing plate and the structure of profile irregularities is provided on the support surface to keep its printability. In this case, if the thickness of the thermosensitive layer is smaller than the coarseness of the structure of the profile irregularities, there are steep areas protruding beyond the surface of the thermosensitive layer, from which heat diffuses. On the contrary, it is considered that the thermal diffusion depression effect is improved since the structure of the profile irregularities according to the present invention is even and there are only few such steep areas of the support protruding beyond the surface of the thermosensitive layer.

DETAILED DESCRIPTION

Figure 1:
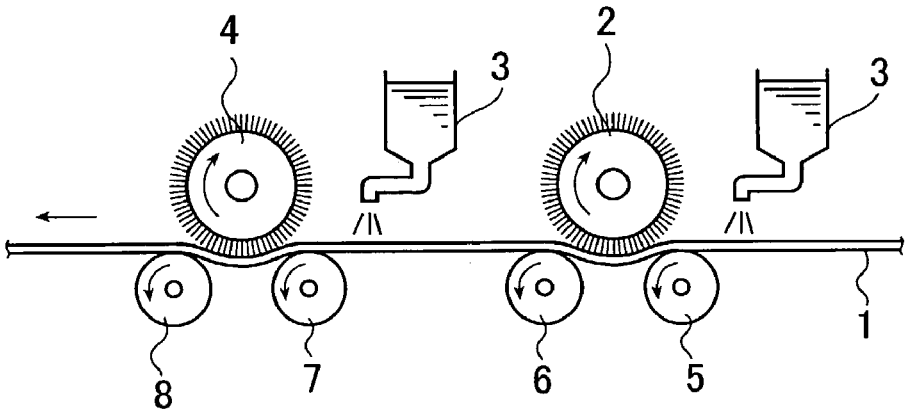
FIG. 1 is a side view showing a concept of a brush graining process used for mechanical graining treatment used in preparation of a support for a lithographic printing plate according to the present invention.

Hereafter, the present invention will be explained in detail.

[Support for Lithographic Printing Plate]

<Grain Shape on Surface>

A support for a lithographic printing plate according to the present invention is characterized by having, on its surface, a grain shape with a structure in which a grained structure with medium undulation of 0.5 to 5 μm average aperture diameter and a grained structure with small undulation of 0.01 to 0.2 μm average aperture diameter are superimposed.

According to the present invention, a grained structure with medium undulation of 0.5 to 5 μm average aperture diameter has functions of retaining an image recording layer mainly by anchoring effect so as to provide contact characteristics. If the average aperture diameter of a pit of the grained structure with medium undulation is less than 0.5 μm, an image recording layer may peel due to decrease in contact characteristics with the image recording layer provided as an upper layer. On the other hand, if the average aperture diameter of the pit of the grained structure with medium undulation exceeds 5 μm, an image recording layer may peel due to decrease in the number of pit boundary areas playing a role of the anchor.

A grained structure with small undulation of 0.01 to 0.2 μm average aperture diameter superimposed on the aforementioned grained structure with medium undulation mainly plays a role of improving the anchoring effect by the grained structure with medium undulation. By combining the grained structure with small undulation with the grained structure with medium undulation, the synergistic effect is obtained so as to retain an image recording layer more strongly. If the average aperture diameter of the pit of the grained structure with small undulation is less than 0.01 μm, the aforementioned effects may not be obtained. On the other hand, if the average aperture diameter of the pit of the grained structure with small undulation exceeds 0.2 μm, the aforementioned anchoring effect by the grained structure with medium undulation may not be obtained since the grained structure with medium undulation is broken.

Combination of the grained structure with medium undulation with the grained structure with small undulation with the grained structure can enhance the hydrophilicity while improving the scum resistance of the non-image area. Since the thermal diffusion depression effect is improved by the combined structure, the hardening reaction of the recording layer fully progresses to enable even image formation and improvement in the contact characteristics between the image recording layer and the support and the sensitivity.

With regard to the grained structure with small undulation, the contact characteristics can be further improved by controlling not only the aperture diameter but also a depth of the pit. That is, the ratio of the depth to the aperture diameter in the grained structure with small undulation should preferably be 0.15 or more, and should more preferably be 0.2 or more.

It is considered that the image recording layer is thus tightly retained on the evenly formed pits with more excellent contact characteristics and that the thermal diffusion depression effect can be further improved.

The aforementioned structure in which a grained structure with medium undulation and a grained structure with small undulation are superimposed may be a structure which is further superimposed by a grained structure with large undulation of 5 to 100 μm average wavelength.

The grained structure with large undulation has an effect of increasing an amount of water retained in the surface of the non-image areas of the lithographic printing plate. The more the water is retained in the surface, the less affected the surface of the non-image areas is by contamination in the atmosphere. This allows obtaining non-image areas that are not easily get dirty even though the printing plate is left as it stands during printing. In addition, if the grained structure with large undulation is superimposed, it is easier to visually inspect an amount of fountain solution supplied to the surface of the printing plate at the time of printing. Namely, inspectability of the lithographic printing plate becomes excellent. If the average wavelength of the grained structure with large undulation is less than 5 μm, there may be no difference from the grained structure with medium undulation. If the average wavelength of the grained structure with large undulation exceeds 100 μm, inspectability of the printing plate may be impaired since the exposed non-image areas appear dazzling after exposure and development. It is preferable that the average wavelength of the grained structure with large undulation is 10 to 80 μm.

In the support for a lithographic printing plate according to the present invention, following are methods of measuring the average aperture diameter of the grained structure with medium undulation on a surface, the average aperture diameter and the average depths with respect thereto of the grained structure with small undulation, and the average wavelength of the grained structure with large undulation.

(1) Average Aperture Diameter of a Grained Structure with Medium Undulation

The surface of a support is photographed at a magnification of 2,000 from right above with an electron microscope. Next, in an electron micrograph obtained, at least 50 pits of the grained structure with medium undulation (pit of medium undulation) in which circumferences of the pits are annularly connected are extracted, the aperture diameters are determined by reading the diameters of the pits, and an average aperture diameter is calculated. In the case of a structure in which a grained structure with large undulation is superimposed also, measurement is made in the same method as in the above.

In addition, in order to suppress dispersion among measurements, an equivalent circle diameter may be measured with commercial image analysis software. In this case, the aforementioned electron micrograph is digitized by being scanned with a scanner, and an equivalent circle diameter is found after it is converted into binary values with the software.

The measurement results by the inventors showed that a visual measurement and that of digitization had almost the same values. In the case of a structure in which the grained structure with large undulation is superimposed, a similar result was obtained.

(2) Average Aperture Diameter of a Grained Structure with Small Undulation

The surface of a support for a lithographic printing plate is photographed at a magnification of 50,000 from right above with a high resolution scanning electron microscope (SEM). In a SEM micrograph obtained, at least 50 pits of the grained structure with small undulation (pit of small undulation) are extracted, the aperture diameter is determined by reading the diameters of the pits and an average aperture diameter is calculated.

(3) Average of Ratio of Depth with Respect to the Aperture Diameter of the Grained Structure with Small Undulation The average of ratio of depth with respect to aperture diameter of the grained structure with small undulation is obtained as follows. A broken-out section of a support is photographed at a magnification of 50,000 with a high resolution SEM. In a SEM micrograph obtained, at least 20 pits of small undulation are extracted, the ratios are obtained by reading the aperture diameters and depths, and an average ratio is calculated.

(4) Average Wavelength of a Grained Structure with Large Undulation

A two-dimensional roughness measurement is performed with a stylus type surface roughness gauge, mean spacing of peaks $S_m$ specified in ISO4287 is measured five times, and its mean value is determined to be an average wavelength.

<Surface Treatment>

A support for a lithographic printing plate according to the present invention is one that, by performing surface treatment on an aluminum plate to be described later, the aforementioned surface grain shape on a surface is formed on the surface of the aluminum plate. While the support for a lithographic printing plate according to the present invention is obtained by performing graining treatment and anodizing treatment on an aluminum plate, the producing method of the support is not particularly limited and may include various processes other than graining treatment and anodizing treatment.

As typical methods of forming the aforementioned grain shape on a surface, the following methods will be explained:

a method by sequentially performing mechanical graining treatment, alkali etching treatment, desmutting treatment with an acid, and electrochemical graining treatment with an electrolyte on an aluminum plate;

a method by performing, for several times, mechanical graining treatment, alkali etching treatment, desmutting treatment with an acid, and electrochemical graining treatment with an electrolyte on an aluminum plate;

a method by sequentially performing alkali etching treatment, desmutting treatment with an acid, and electrochemical graining treatment with an electrolyte on an aluminum plate; and a method by performing, for several times, alkali etching treatment, desmutting treatment with an acid, and electrochemical graining treatment with an electrolyte on an aluminum plate. However, according to the present invention, the method is not limited to the above. In these methods, alkali etching treatment and desmutting treatment may be further performed after the electrochemical graining treatment as above is performed.

As described above, two or more structures having profile irregularities arranged at different intervals are formed in a superimposed manner on the surface of the support for a lithographic printing plate according to the present invention as obtained by these methods. The image recording layer is tightly retained on the support which exhibits improved contact characteristics and excellent hydrophilicity. Further, due to the improvement in the thermal diffusion depression effect as described above, the hardening reaction of the recording layer fully progresses to enable even image formation leading to the improvement in the contact characteristics between the image recording layer and the support and the sensitivity.

The respective surface treatment processes will now be described in detail.

<Mechanical Graining Treatment>

Mechanical graining treatment is effective means for graining treatment since it is capable of forming a surface with average wavelength 5 to 100 $\mu$m asperities at a lower cost than electrochemical graining treatment.

Mechanical graining treatment that can be used includes wire brush graining treatment by scratching an aluminum plate surface with metal wire, ball graining treatment by performing graining on an aluminum plate surface with an abrasive ball and an abrasive agent, and brush graining treatment by performing graining on a surface with a nylon brush and an abrasive agent as described in JP 6-135175 A and JP 50-40047 B.

In addition, a transfer method in which a surface with asperities is pressed onto an aluminum plate can be also employed. That is, applicable methods include those described in JP 55-74898 A, JP 60-36195 A and JP 60-203496 A, as well as a method described in JP 6-55871 A characterized by performing transfer several times, and a method described in JP 6-024168 A characterized in that the surface is elastic.

It is also possible to use a method by repeatedly performing transfer using a transfer roller on which fine asperities are etched with electric discharge machining, shot blast, laser, plasma etching or the like, and a method in which a surface with asperities on which fine particles are applied is allowed to contact with an aluminum plate, pressure is applied on that several times, and transfer of the asperity pattern equivalent to average diameter of fine particles is repeatedly performed on an aluminum plate several times. A method of providing fine asperities to a transfer roll includes methods known to the public, as described in JP 3-8635 A, JP 3-66404 A, JP 63-65017 A or the like. In addition, fine grooves may be engraved on the surface of the transfer roll from two directions with a dice, a turning tool, a laser or the like to form square asperities on the surface. Also, publicly known etching treatment or the like may be performed on the surface of the transfer roll such that the formed square asperities become round.

In addition, hardening, hard chrome plating or the like may be performed to increase hardness of a surface.

Moreover, mechanical graining treatment may include methods as described in JP 61-162351 A, JP 63-104889 A or the like.

In the present invention, each method as above may be used in combination with others, taking productivity or the like into consideration. It is preferable that these mechanical graining treatments are performed before electrochemical graining treatment.

Hereafter, brush graining treatment preferably used as mechanical graining treatment will be explained.

Brush graining treatment generally uses a roller-like brush in which a lot of synthetic resin brushes made of synthetic resin such as nylon (trademark), polypropylene and PVC resin are implanted on the surface of a cylindrical drum, and treatment is performed by scrubbing one or both of the surfaces of the aluminum plate while spraying a slurry containing an abrasive over a rotating roller-like brush. An abrasive roller on which an abrasive layer is provided may be also used in place of the roller-like brush and a slurry.

When a roller-like brush is used, bending elastic modulus is preferably 10,000 to 40,000 kg/cm$^2$, more preferably 15,000 to 35,000 kg/cm$^2$, and a treatment should use a brush with bristle elasticity of, preferably 500 g or less, more preferably 400 g or less. The diameter of the bristle is generally 0.2 to 0.9 mm. While the length of the bristle can be appropriately determined depending on the outer diameter of the roller-like brush and the diameter of the drum, it is generally 10 to 100 mm.

As to an abrasive, a publicly known one may be used. Abrasives that can be used include pumice, silica sand, aluminum hydroxide, alumina powder, silicon carbide, silicon nitride, volcanic ash, carborundum, emery, and mixtures thereof. Pumice and silica sand are preferable among them. Silica sand is particularly preferable because of excellent graining efficiency since it is harder than pumice and is not easily broken compared to pumice.

A preferable average particle diameter of the abrasive is 3 to 50 $\mu$m, and more preferably 6 to 45 $\mu$m, from the viewpoint of excellent graining efficiency and that graining pitch can be narrowed.

An abrasive is, for example, suspended in water and used as a slurry. Beside abrasives, thickener, dispersant (for example, surfactant), antiseptic agent or the like may be contained in the slurry. It is preferable that the specific gravity of a slurry is 0.5 to 2.

As an apparatus suitable for mechanical graining treatment, for example, includes an apparatus as described in JP 50-40047 B.

<Electrochemical Graining Treatment>

Electrochemical graining treatment may use an electrolyte used for electrochemical graining treatment with an ordinary alternating current. Particularly, a structure of asperities unique to the present invention may be formed on a surface by using an electrolyte mainly composed of hydrochloric acid or nitric acid.

As electrolytic graining according to the present invention, it is preferable that the first and second electrolytic treatments are performed in an acid solution in alternating corrugated current before and after the cathode electrolytic treatment. Hydrogen gas is generated on the surface of an aluminum plate to produce smut by cathode electrolytic treatment, thereby creating an even surface condition. This allows the even graining treatment to be performed at the time of electrolytic treatment by the subsequent alternating corrugated current.

This electrolytic graining treatment can follow the electrochemical graining treatment (electrolytic graining treatment) as described in JP 48-28123 B and GB 896,563, for example. Although this electrolytic graining treatment uses sine waveform alternating current, a special waveform may be used as described in JP 52-58602 A. In addition, a waveform as described in JP 3-79799 A can be also used. Moreover, the methods as described in JP 55-158298 A, JP 56-28898 A, JP 52-58602 A, JP 52-152302 A, JP 54-85802 A, JP 60-190392 A, JP 58-120531 A, JP 63-176187 A, JP 1-5889 A, JP 1-280590 A, JP 1-118489 A, JP 1-148592 A, JP 1-178496 A, JP 1-188315 A, JP 1-154797 A, JP 2-235794 A, JP 3-260100 A, JP 3-253600 A, JP 4-72079 A, JP 4-72098 A, JP 3-267400 A and JP 1-141094 A may also be used. In addition, besides the aforementioned, it is also possible to perform electrolysis using a special frequency alternating current proposed as a method for producing an electrolytic capacitor. It is described for example in U.S. Pat. No. 4,276,129 and U.S. Pat. No. 4,676,879.

While an electrolytic bath and power supply are variously proposed, those as described in U.S. Pat. No. 4,203,637, JP 56-123400 A, JP 57-59770 A, JP 53-12738 A, JP 53-32821 A, JP 53-32822 A, JP 53-32823 A, JP 55-122896 A, JP 55-132884 A, JP 62-127500 A, JP 1-52100 A, JP 1-52098 A, JP 60-67700 A, JP 1-230800 A, JP 3-257199 A or the like can be used.

In addition, those as described in JP 52-58602 A, JP 52-152302 A, JP 53-12738 A, JP 53-12739 A, JP 53-32821 A, JP 53-32822 A, JP 53-32833 A, JP 53-32824 A, JP 53-32825 A, JP 54-85802 A, JP 55-122896 A, JP 55-132884 A, JP 48-28123 B, JP 51-7081 B, JP 52-133838 A, JP 52-133840 A, JP 52-133844 A, JP 52-133845 A, JP 53-149135 A, JP 54-146234 A or the like can be used.

As an acid solution that is an electrolyte, in addition to nitric acid and hydrochloric acid, the electrolytes as described in U.S. Pat. No. 4,671,859, U.S. Pat. No. 4,661,219, U.S. Pat. No. 4,618,405, U.S. Pat. No. 4,600,482, U.S. Pat. No. 4,566,960, U.S. Pat. No. 4,566,958, U.S. Pat. No. 4,566,959, U.S. Pat. No. 4,416,972, U.S. Pat. No. 4,374,710, U.S. Pat. No. 4,336,113 and U.S. Pat. No. 4,184,932 or the like can be used.

The concentration of an acid solution should preferably be 0.5 to 2.5 wt %, and it should be particularly preferably 0.7 to 2.0 wt %, taking the use for desmutting treatment into account. In addition, the temperature of a solution should preferably be 20 to 80° C., and should more preferably be 30 to 60° C.

An aqueous solution mainly composed of hydrochloric acid or nitric acid can be used in such a manner that at least one of nitrates having nitrate ion such as aluminum nitrate, sodium nitrate and ammonium nitrate or chlorides having chlorine ion such as aluminum chloride, sodium chloride and ammonium chloride is added in a range from 1 g/L to a saturation point to hydrochloric acid or nitric acid aqueous solution of the concentration 1 to 100 g/L. In addition, metals contained in aluminum alloys such as iron, copper, manganese, nickel, titanium, magnesium and silicon may be dissolved in the aqueous solution mainly composed of hydrochloric acid or nitric acid. It is preferable that a solution in which aluminum chloride, aluminum nitrate and the like are added to an aqueous solution containing hydrochloric acid or nitric acid of the concentration of 0.5 to 2 wt % so as to allow aluminum ion of 3 to 50 g/L to be contained is used.

In addition, it is possible to perform the even graining also on an aluminum plate containing a large amount of copper by adding a compound capable of forming a complex with copper and using it. Compounds capable of forming a complex with copper include ammonia; amines obtained by substituting hydrogen atom in ammonia by hydrocarbon group (aliphatic and aromatic, or the like) or the like, such as methylamine, ethylamine, dimethylamine, diethylamine, trimethylamine, cyclohexylamine, triethanolamine, triisopropanolamine, EDTA (ethylenediaminetetraacetic acid); metal carbonates such as sodium carbonate, potassium carbonate and potassium hydrogencarbonate. Ammonium salts such as ammonium nitrate, ammonium chloride, ammonium sulfate, ammonium phosphate and ammonium carbonate are also included.

The temperature should preferably be 10 to 60° C., and should more preferably be 20 to 50° C.

Figure 2:
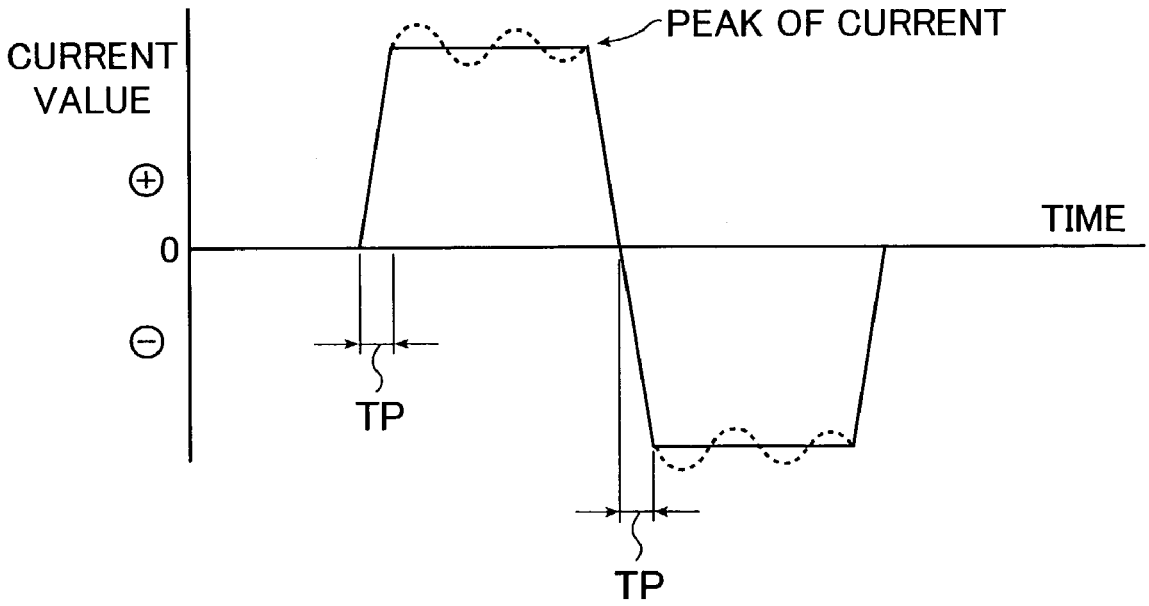
FIG. 2 is a graph showing an example of a trapezoidal current waveform view used for electrochemical graining treatment used in preparation of a support for a lithographic printing plate according to the present invention.

Alternating current power supply wave used for electrochemical graining treatment is not particularly limited and sine wave, square wave, trapezoidal wave, triangle wave or the like is used. Square wave or trapezoidal wave is preferable, and trapezoidal wave is particularly preferable. Trapezoidal wave is one as shown in FIG. 2. It is preferable that with this trapezoidal wave, a time required for the current to reach a peak from zero (TP) is 0.1 to 2 msec. If it is less than 0.1 msec, non-uniformity in treatment called chatter mark is easily generated in a direction perpendicular to a traveling direction of an aluminum plate. If TP exceeds 3 msec, particularly when nitric acid electrolyte is used, an aluminum plate is easily affected by trace components in an electrolyte represented by ammonium ion or the like that spontaneously increase in electrochemical graining treatment, thus the even graining is not easily performed. As a result, scum resistance is likely to deteriorate when a lithographic printing plate is prepared.

Further, insufficient adhesion of the support to the image recording layer and uneven thickness of the recording layer applied on the support may often reduce the thermal diffusion depression effect, leading to inferior sensitivity.

Trapezoidal wave alternating current with a duty ratio of 1:2 to 2:1 is usable, and duty ratio should preferably be 1:1 in an indirect power supplying system dispensing with a conductor roll for aluminum as described in JP 5-195300 A.

While trapezoidal wave alternating current with a frequency of 0.1 to 120 Hz is usable, frequency should preferably be 50 to 70 Hz in terms of equipment. If it is lower than 50 Hz, the carbon electrode of a main electrode is easily dissolved, and if it is higher than 70 Hz, it is easily affected by the components of inductance in a power supply circuit, thus an electric power cost increases.

Figure 3:
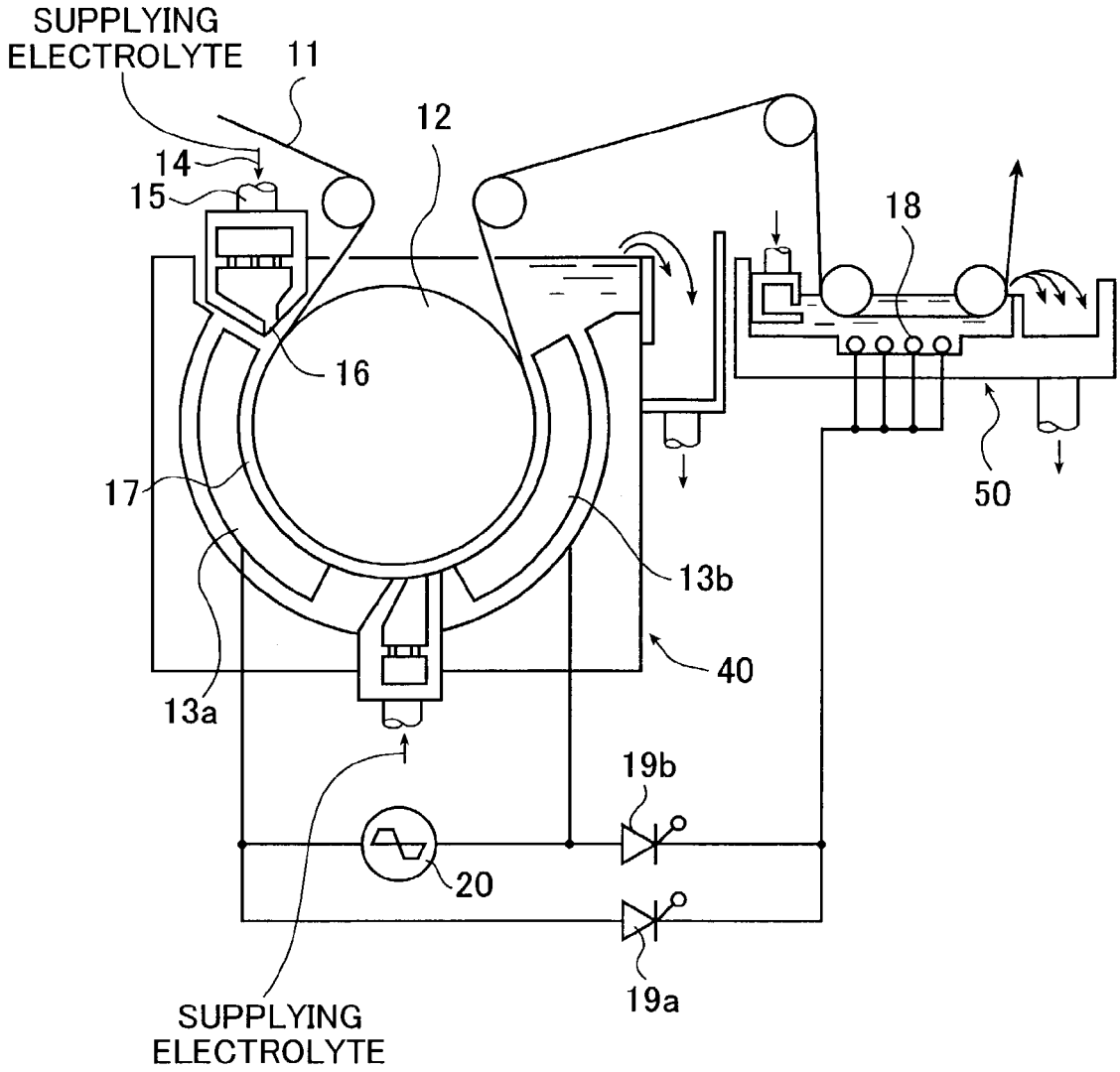
FIG. 3 is a side view showing an example of a radial cell used for electrochemical graining treatment using alternating current used in preparation of a support for a lithographic printing plate according to the present invention.

One or more alternating current power supplies can be connected to an electrolytic bath. It is preferable that, as shown in FIG. 3, an auxiliary anode is installed and a part of alternating current is shunted, for the purpose of controlling the current ratio at the anode and the cathode of alternating current applied to an aluminum plate opposite to the main electrode so as to perform the even graining and dissolve carbon in the main electrode. In FIG. 3, a reference numeral 11 denotes an aluminum plate, 12 denotes a radial drum roller, 13*a* and 13*b* denote main electrodes, 14 denotes an electrolyte, 15 denotes an electrolyte feed port, 16 denotes a slit, 17 denotes an electrolyte path, 18 denotes an auxiliary anode, 19*a* and 19*b* denote thyristors, 20 denotes an alternating current power supply, 40 denotes a main electrolytic bath, and 50 denotes an auxiliary anodizing bath. By shunting a part of a current value to an auxiliary anode provided in a bath different from the two main electrode baths in the two main electrodes as direct current via a rectifying device or a switching device, the ratio of a current value used for an anodizing reaction with respect to a current value used for a cathodic reaction reacting on the aluminum plate opposite to the main electrode can be controlled. It is preferable that the ratio of amount of electricity (amount of electricity at cathode/amount of electricity at anode) used for an anodizing reaction and a cathodic reaction on the aluminum plate opposite to the main electrode is 0.3 to 0.95.

While an electrolytic bath used for a publicly known surface treatment such as a vertical type, a flat type and a radial type is usable, a radial type electrolytic bath as described in JP 5-195300 A is particularly preferable. The direction of travel of an electrolyte which passes through the electrolytic bath may be parallel with or perpendicular to that of an aluminum web.

(Electrolysis with Nitric Acid)

A pit with average aperture diameter of 0.5 to 5 $\mu$m can be formed by performing electrochemical graining treatment using an electrolyte mainly composed of nitric acid. If amount of electricity is, however, relatively large, an electrolytic reaction concentrates to produce a honeycomb pit with an aperture diameter of even more than 5 $\mu$m.

In order to obtain graining like this, the total amount of electricity used for the anodizing reaction of the aluminum plate at a time when an electrolytic reaction is completed should preferably be 1 to 1,000 C/dm$^2$, and should more preferably be 50 to 300 C/dm$^2$. It is preferable that current density is 20 to 100 A/dm$^2$ in this case.

If an electrolyte containing nitric acid of a high concentration or a high temperature is used, a grained structure with small undulation of average aperture diameter of 0.2 $\mu$m or less can be also formed.

(Electrolysis with Hydrochloric Acid)

Since hydrochloric acid per se has a strong aluminum solvency, it is possible to form micro asperities on its surface by merely applying a little electrolysis thereon. These micro asperities are of average aperture diameter 0.01 to 0.2 $\mu$m and are evenly formed on the entire surface of the aluminum plate. In order to obtain graining like this, the total amount of electricity used for the anodizing reaction of an aluminum plate at a time when an electrolytic reaction is completed should preferably be 1 to 100 C/dm$^2$, more preferably be 20 to 70 C/dm$^2$. It is preferable that current density is 20 to 50 A/dm$^2$ in this case.

It is also possible to simultaneously form a crater-like large undulation by increasing the total amount of electricity used for an anodizing reaction to 400 to 1,000 C/dm$^2$ in electrochemical graining treatment with an electrolyte mainly composed of hydrochloric acid like this. In this case, micro asperities of average aperture diameter 0.01 to 0.4 $\mu$m are formed on the entire surface, being superimposed on a crater-like large undulation of average aperture diameter 10 to 30 $\mu$m. Therefore, since a grained structure with medium undulation of average aperture diameter 0.5 to 5 $\mu$m can not be superimposed thereon in this case, the graining of a surface that is the characteristic of the present invention can not be produced.

It is preferable that in the present invention, electrolytic graining treatment with an electrolyte mainly composed of nitric acid (electrolysis with nitric acid) as mentioned above is performed as the first electrolytic graining treatment, and electrolytic graining treatment with an electrolyte mainly composed of hydrochloric acid (electrolysis with hydrochloric acid) as mentioned above is performed as the second electrochemical graining treatment. That is, the present invention also provides a method of producing a support for a lithographic printing plate by sequentially performing electrolysis with nitric acid and electrolysis with hydrochloric acid on at least an aluminum plate as graining treatment, and further performing anodizing treatment.

It is preferable that cathode electrolytic treatment is performed on the aluminum plate between the first and the second electrolytic graining treatments in electrolyte containing nitric acid, hydrochloric acid or the like, as mentioned above. This cathode electrolytic treatment allows smut to be produced on the surface of the aluminum plate and hydrogen gas to be generated, and thus electrolytic graining treatment can be more evenly performed. This cathodic electrolytic treatment is performed with cathodic amount of electricity preferably 3 to 80 C/dm$^2$ in an acid solution, and more preferably 5 to 30 C/dm$^2$. If cathodic amount of electricity is less than 3 C/dm$^2$, an amount of attached smut may be insufficient, and if it exceeds 80 C/dm$^2$, an amount of attached smut may be too excessive. Both cases are not preferable. In addition, the cathodic electrolytic treatment may use the same electrolytes used for the first and second electrolytic graining treatments, or a different electrolyte.

<Alkali Etching Treatment>

Alkali etching treatment is a treatment that dissolves a surface layer of the aforementioned aluminum plate by allowing the aluminum plate to contact with an alkali solution.

Alkali etching treatment performed before electrolytic graining treatment is performed to remove rolling oil, dirt, naturally oxidized layer or the like on the surface of the aluminum plate (rolled aluminum) if mechanical graining treatment is not performed thereon, and is performed to dissolve edge portions of asperities generated by mechanical graining treatment to change steeper asperities on the surface to a smoother surge surface if mechanical graining treatment has been already performed.

If mechanical graining treatment is not performed before alkali etching treatment, an amount of etching should preferably be 0.1 to 10 g/m$^2$, and more preferably be 1 to 5 g/m$^2$. If an amount of etching is less than 0.1 g/m$^2$, pits can not be formed evenly to produce non-uniformity in electrolytic graining treatment to be performed later since rolling oil, dirt, naturally oxidized layer or the like may be left on the surface of a plate. On the other hand, if an amount of etching is 1 to 10 g/m$^2$, rolling oil, dirt, naturally oxidized layer and the like are fully removed from the surface of a plate. If an amount of etching exceeds that range, it is less economical.

If mechanical graining treatment is performed before alkali etching treatment, an amount of etching should preferably be 3 to 20 g/m$^2$, and more preferably be 5 to 15 g/m$^2$. If an amount of etching is less than 3 g/m$^2$, the asperities formed by mechanical graining treatment or the like may not be sometimes smoothed, and pits can not be evenly formed in electrolytic treatment to be performed later. In addition, dirt may deteriorate during printing. On the other hand, if an amount of etching exceeds 20 g/m$^2$, asperities structure will disappear.

Alkali etching treatment just after electrolytic graining treatment is performed to dissolve smut produced in an acid electrolyte and to dissolve edge portions of pits formed by electrolytic graining treatment.

An optimum amount of etching varies since a pit formed by electrolytic graining treatment varies according to the kind of an electrolyte. However, it is preferable that an amount of etching in alkali etching treatment after electrolytic graining treatment is 0.1 to 5 g/m$^2$. If a nitric acid electrolyte is used, it is necessary to set an amount of etching to a greater amount than that of the case a hydrochloric acid electrolyte is used.

If electrolytic graining treatment is performed several times, alkali etching treatment can be performed after each electrolytic graining treatment as required.

Alkali used for an alkali solution includes, for example, caustic alkali and alkali metal salts. More specifically, it includes sodium hydroxide and potassium hydroxide. In addition, it includes silicates of alkali metals such as sodium metasilicate, sodium silicate, potassium metasilicate, potassium silicate; carbonates of alkali metals such as sodium carbonate and potassium carbonate; aluminates of alkali metals such as sodium aluminate and potassium aluminate; aldonates of alkali metals such as sodium gluconates and potassium gluconates; phosphates of alkali metals such as disodium hydrogenphosphate, dipotassium hydrogenphosphate, sodium phosphate and potassium phosphate. Among them a caustic alkali solution and a solution containing both a caustic alkali and aluminate of alkali metal are preferable from a viewpoint that the rate of etching is fast and costs are lower. Particularly, an aqueous solution of sodium hydroxide is preferable.

The concentration of an alkali solution can be determined in accordance with an amount of etching, and it should preferably be 1 to 50 wt %, more preferably be 10 to 35 wt %. If aluminum ion is dissolved in an alkali aqueous solution, the concentration of aluminum ion should preferably be 0.01 to 10 wt %, more preferably be 3 to 8 wt %. It is preferable that the temperature of an alkali aqueous solution is 20 to 90° C., and treatment time is 1 to 120 seconds.

Methods of allowing an aluminum plate to contact with an alkali solution include, for example, a method by allowing an aluminum plate to pass through a bath containing an alkali solution, a method by allowing an aluminum plate to be immersed in a bath containing an alkali solution, and a method by spraying an alkali solution over the surface of an aluminum plate.

<Desmutting Treatment>

After electrolytic graining treatment or alkali etching treatment is performed, pickling (desmutting treatment) is performed to remove dirt (smut) left on the surface of a plate. Acids that are used include nitric acid, sulfuric acid, phosphoric acid, chromic acid, hydrofluoric acid, borofluoric acid or the like.

The desmutting treatment is performed by allowing the aluminum plate to contact with an acid solution of concentration 0.5 to 30 wt % of hydrochloric acid, nitric acid, sulfuric acid or the like (aluminum ion 0.01 to 5 wt % contained). A method of allowing an aluminum plate to contact with an acid solution include, for example, a method by allowing an aluminum plate to pass through a bath containing an acid solution, a method by allowing an aluminum plate to be immersed in a bath containing an acid solution, and a method by spraying an acid solution over the surface of an aluminum plate.

In desmutting treatment, an acid solution that can be used includes a wastewater of an aqueous solution mainly containing nitric acid or an aqueous solution mainly containing hydrochloric acid discharged in the electrolytic treatment described above, or a wastewater of an aqueous solution mainly containing sulfuric acid discharged in anodizing treatment described later.

It is preferable that a solution temperature of desmutting is 25 to 90° C. It is preferable that a treatment time is 1 to 180 seconds. Aluminum and aluminum alloy components may be dissolved in an acid solution used for desmutting treatment.

<Anodizing Treatment>

Anodizing treatment is further performed on the aluminum plate processed as above. Anodizing treatment can be performed in the same method as a method conventionally performed in this field of technology.

In this case, for example, a current is allowed to pass through the aluminum plate acting as an anode in a solution having a sulfuric acid concentration of 50 to 300 g/L and an aluminum ion concentration of 5 wt % to thereby form an anodized layer. Sulfuric acid, phosphoric acid, chromic acid, oxalic acid, sulfamic acid, benzenesulfonic acid, amidesulfonic acid or the like can be used alone or in combination for the solution used in the anodizing treatment.

In this case, components normally contained in an aluminum plate, an electrode, city water, an underground water or the like may be contained in an electrolyte. A second and a third components may be further added thereto. The second and third components for example may include metal ions such as Na, K, Mg, Li, Ca, Ti, Al, V, Cr, Mn, Fe, Co, Ni, Cu and Zn; cation such as ammonium ion; anion such as nitrate ion, carbonate ion, chloride ion, phosphate ion, fluoride ion, sulfite ion, titanate ion, silicate ion and borate ion. Each of them may be contained in the concentration of approximately 0 to 10,000 ppm in an electrolyte.

Although the conditions of anodizing treatment can not be indiscriminately determined since they are variously changed according to an electrolyte to be used, generally appropriate conditions are the concentration of an electrolyte: 1 to 80 wt %, the temperature of an electrolyte: 5 to 70° C., the current density: 0.5 to 60 A/dm$^2$, the voltage: 1 to 100 V and the time of electrolysis: 15 seconds to 50 minutes and they are so controlled as to produce the desired amount of an anodized layer.

In addition, the methods as described in JP 54-81133 A, JP 57-47894 A, JP 57-51289 A, JP 57-51290 A, JP 57-54300 A, JP 57-136596 A, JP 58-107498 A, JP 60-200256 A, JP 62-136596 A, JP 63-176494 A, JP 4-176897 A, JP 4-280997 A, JP 6-207299 A, JP 5-24377 A, JP 5-32083 A, JP 5-125597 A, JP 5-195291 A or the like may be used.

It is preferable that a sulfuric acid solution is used as an electrolyte as described in JP 54-12853 A and JP 48-45303 A among others. It is preferable that the concentration of sulfuric acid in an electrolyte is 10 to 300 g/L (1 to 30 wt %). In addition, the concentration of aluminum ion should preferably be 1 to 25 g/L (0.1 to 2.5 wt %), and more preferably be 2 to 10 g/L (0.2 to 1 wt %). An electrolyte like this can be prepared by adding aluminum sulfate or the like to a diluted sulfuric acid of concentration 50 to 200 g/L, for example.

If anodizing treatment is performed in an electrolyte containing sulfuric acid, either of direct current or alternating current can be impressed in-between an aluminum plate and an opposite pole.

If direct current is impressed to an aluminum plate, the current density should preferably be 1 to 60 A/dm$^2$, and more preferably to be 5 to 40 A/dm$^2$ If anodizing treatment is continuously performed, it is preferable that in order to prevent so-called "burning" caused by concentration of current on a part of an aluminum plate, current with low current density of 5 to 10 A/dm$^2$ be allowed to flow at the beginning of anodizing treatment and the current density be increased to 30 to 50 A/dm$^2$ or higher while anodizing treatment progresses.

It is preferable that if anodizing treatment is continuously performed, the treatment is performed by an electric power supplying system via solution, in which electric power is supplied to an aluminum plate through an electrolyte.

A porous layer having many holes called pore (micropore) is obtained by performing anodizing treatment under the conditions like this. Generally, its average pore diameter is about 5 to 50 nm, and its average pore density is about 300 to 800 pcs/$\mu$m$^2$.

In the present invention, quantity of the anodized layers is preferably 1 to 5 g/m$^2$. If it is less than 1 g/m$^2$, plates are scratched easily. If it is more than 5 g/m$^2$, a large quantity of electricity is needed for the production, which is economically disadvantageous. Quantity of the anodized layers is more preferably 1.5 to 4 g/m$^2$.

Further, anodizing treatment is preferably performed so that the anodized layer on the aluminum plate has a difference of deposit amount of not more than 1 g/m$^2$ between the central portion and the vicinity of the edge portion.

Device for electrolysis as described in JP 48-26638 A, JP 47-18739 A, JP 58-24517 B or the like may be used for anodizing treatment.

Figure 4:
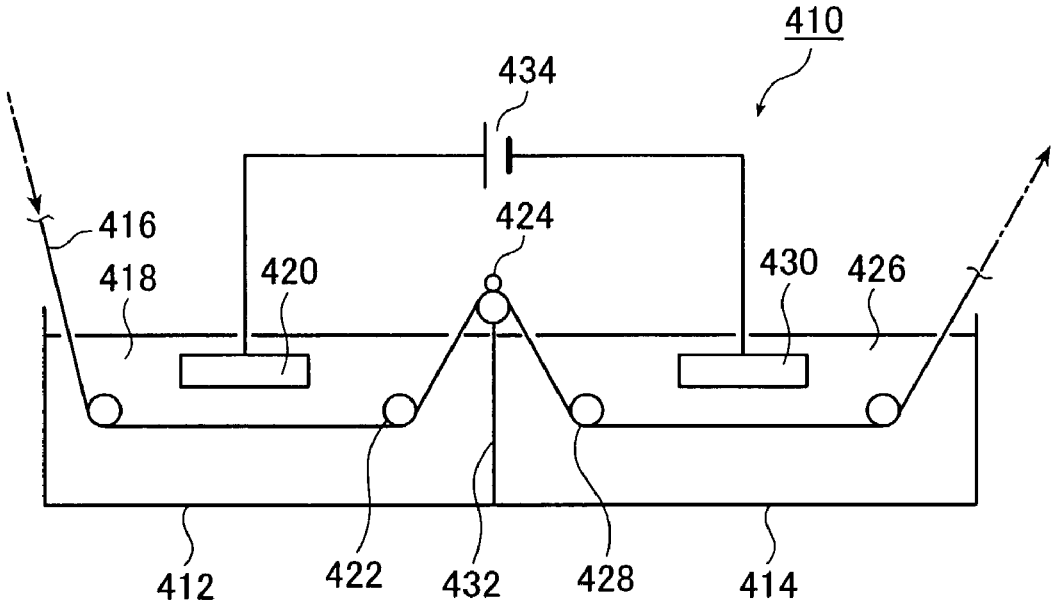
FIG. 4 is a schematic view of an anodizing device used for anodizing treatment used in preparation of a support for a lithographic printing plate according to the present invention.

Among those, device as shown in FIG. 4 is preferably used. FIG. 4 is a schematic view that shows one example of device which performs anodizing treatment on an aluminum plate surface. In anodizing device 410, an aluminum plate 416 is transferred as shown by an arrow in FIG. 4. The aluminum plate 416 is positively charged by a feeding electrode 420 in a feeding bath 412 where an electrolyte 418 is stored. Then, after the aluminum plate 416 is transferred upward by a roller 422 in the feeding bath 412 and the direction of the transfer is changed downward by a nip roller 424, the plate is transferred to an electrolytic cell 414 where an electrolyte 426 is stored and the direction of the plate is changed to a horizontal direction by a roller 428. Thereafter, an anodized layer is formed on the surface of the aluminum plate 416 by negatively charging the plate with an electrolytic electrode 430, and the aluminum plate 416 coming out of the electrolytic cell 414 is transferred to a following process. In the anodizing treatment device 410, direction changeover means is composed of the roller 422, the nip roller 424, and the roller 428. The aluminum plate 416 is transferred in a mountain shape and a reversed U shape between the feeding bath 412 and the electrolytic cell 414 by the rollers 422, 424 and 428. The feeding electrode 420 and the electrolytic electrode 430 are connected to a direct current power supply 434.

The anodizing device 410 as shown in FIG. 4 is characterized by the feeding bath 412 and the electrolytic cell 414 partitioned with a bath wall 432, and transferring the aluminum plate 416 in a mountain shape and in a reversed U shape between the baths, whereby length of the aluminum plate 416 between the baths can be made to the shortest. Consequently, since the entire length of the anodizing device 410 can be shortened, the cost of equipment can be reduced. In addition, since the aluminum plate 416 is transferred in a mountain shape and a reversed U shape, the necessity of forming an aperture in the bath walls of each of the baths 412 and 414, through which the aluminum plate 416 is allowed to pass, is eliminated. Therefore, an amount of a supplied solution required to keep a solution level at a predetermined level in each bath 412 and 414 can be reduced, so that the operation cost can be reduced.

<Sealing Treatment>

In the present invention, sealing treatment for sealing micropores existent in the anodized layer may be performed as required. Sealing treatment may be performed according to the publicly known methods such as boiling water treatment, hot water treatment, steaming treatment, sodium silicate treatment, nitrite treatment and ammonium acetate treatment. The sealing treatment may be performed with the device and by the methods as described in JP 56-12518 B, JP 4-4194 A, JP 5-202496 A, JP 5-179482 A or the like, for example.

<Treatment for Water Wettability>

Treatment for water wettability may be performed after anodizing treatment or sealing treatment is performed. Treatments for water wettability include potassium fluorozirconate treatment as described in U.S. Pat. No. 2,946,638, phosphomolybdate treatment as described in U.S. Pat. No. 3,201,247, alkyltitanate treatment as described in GB 1,108,559, polyacrylic acid treatment as described in DE 1,091,433, polyvinylphosphonic acid treatment as described in DE 1,134,093 and GB 1,230,447, phosphonic acid treatment as described in JP 44-6409 B, phytic acid treatment as described in U.S. Pat. No. 3,307,951, treatment with a salt of lipophilic organic high-molecular compound and divalent metal as described in JP 58-16893 A and JP 58-18291 A, treatment providing undercoat layer of hydrophilic cellulose (for example, carboxylmethylcellulose) containing water-soluble metallic salts (for example, zinc acetate) as described in U.S. Pat. No. 3,860,426 and treatment to apply undercoating of water-soluble polymer having sulfo group as described in JP 59-101651 A.

In addition, compounds used for undercoating treatment include phosphate as described in JP 62-019494 A, water-soluble epoxide compound as described in JP 62-033692 A, phosphoric acid-treated starch as described in JP 62-097892 A, diamines as described in JP 63-056498 A, inorganic amino acid or organic amino acid as described in JP 63-130391 A, organic phosphonic acid containing carboxy group or hydroxy group as described in JP 63-145092 A, compounds containing amino group and phosphonic group as described in JP 63-165183 A, specified carboxylic acid derivatives as described in JP 2-316290 A, phosphoric ester as described in JP 3-215095 A, compounds having one amino group and one oxoacid group of phosphor as described in JP 3-261592 A, aliphatic or aromatic sulfonic acid such as phenylsulfonic acid as described in JP 5-246171 A, compounds containing S atom such as thiosalicylic acid as described in JP 1-307745 A, and compounds having oxoacid group of phosphor as described in JP 4-282637 A.

In addition, coloring by an acid dye as described in JP 60-64352 A can be performed.

It is preferable that treatment for water wettability is performed by a method of dipping an object into an aqueous solution containing alkali metal silicates such as sodium silicate and potassium silicate, a method of forming a hydrophilic undercoat layer by applying a hydrophilic vinylpolymer or a hydrophilic compound or the like.

Treatment for water wettability with an aqueous solution containing alkali metal silicates such as sodium silicate and potassium silicate can be performed in accordance with the methods and steps as described in U.S. Pat. No. 2,714,066 and U.S. Pat. No. 3,181,461.

Alkali metal silicates include sodium silicate, potassium silicate and lithium silicate. An aqueous solution containing alkali metal silicates may contain an appropriate amount of sodium hydroxide, potassium hydroxide, lithium hydroxide or the like.

In addition, an aqueous solution containing alkali metal silicates may contain alkaline-earth metallic salts or fourth group (IVA group) metallic salts. Examples of alkaline-earth metallic salts are nitrates such as calcium nitrate, strontium nitrate, magnesium nitrate and barium nitrate; sulfates; chlorides; phosphates; acetates; oxalates; and borates. Examples of fourth group (IVA group) metallic salts are titanium tetrachloride, titanium trichloride, potassium titanium fluoride, potassium titanium oxalate, titanium sulfate, titanium tetraiodide, zirconium oxide chloride, zirconium dioxide, zirconium oxychloride, zirconium tetrachloride. These alkali earth metallic salts and fourth group (IVA group) metallic salts can be used in either of a single form or combinations of two kinds or more.

An amount of Si adsorbed by alkali metal silicate treatment can be measured with a fluorescent X-ray analyzer, and its adsorbed amount should preferably be about 1.0 to 15.0 $mg/m^2$.

An effect to improve insolubility of the surface of a support for a lithographic printing plate with respect to an alkali developer can be obtained by performing this alkali metal silicate treatment. Further, since the elution of an aluminum component into the developer is suppressed, the generation of a development scum attributable to the exhaust of the developer can be reduced.

In addition, treatment for water wettability by forming a hydrophilic undercoat layer may be performed under the conditions and steps as described in JP 59-101651 A and JP 60-149491 A.

An example of hydrophilic vinylpolymer to be used in this method is a copolymer of vinylpolymerizable compound having sulfo group such as polyvinylsulfonic acid and p-styrenesulfonic acid that has sulfo group, with ordinary vinylpolymerizable compound such as (meta)acrylic alkylester. In addition, an example of a hydrophilic compound to be used in the method is a compound containing at least one selected from a group consisting of —$NH_2$ group, —COOH group, and sulfo group.

<Water Washing Treatment>

It is preferable that water washing is performed after aforementioned each treatment is finished. Pure water, well water, city water or the like can be used for water washing. It is acceptable that a nip device may be used to prevent the treatment solution from being brought into the next process.

<Aluminum Plate (Rolled Aluminum)>

An aluminum plate publicly known can be used to obtain a support for a lithographic printing plate according to the present invention. An aluminum plate used in the present invention is a metal having an aluminum which is stable in dimension as a main component, and is composed of aluminum or aluminum alloy. Besides a pure aluminum plate, an alloy plate containing aluminum as main component and a trace of different elements can be used.

In the present invention, various substrates composed of the aforementioned aluminum or aluminum alloys, and referred to collectively as an aluminum plate. Different elements that may be contained in the aluminum alloy are silicon, iron, manganese, copper, magnesium, chromium, zinc, bismuth, nickel, titanium or the like, and the contents of the different elements in the alloy is 10 wt % or less.

Like this, the composition of an aluminum plate used in the present invention is not specified. For example, the materials conventionally known as described in Aluminum Handbook 4th edition (published by Japan Light Metal Association in 1990) that are, for example, an Al—Mn system aluminum plate of JIS A1050, JIS A1100, JIS A1070, JIS A3004 containing Mn, the internationally registered alloy 3103A and the like can be appropriately utilized. In addition, an Al—Mg system alloy and Al—Mn—Mg system alloy (JIS A3005) into which 0.1 wt % or more of Mg is added can be used to increase tensile strength. Moreover, Al—Zr system or Al—Si system alloy containing Zr or Si can be used. Further, Al—Mg—Si system alloy can also be used.

With regard to JIS1050 materials, the arts that have been proposed by the inventors of the present invention are described in JP 59-153861 A, JP 61-51395 A, JP 62-146694 A, JP 60-215725 A, JP 60-215726 A, JP 60-215727 A, JP 60-216728 A, JP 61-272367 A, JP 58-11759 A, JP 58-42493 A, JP 58-221254 A, JP 62-148295 A, JP 4-254545 A, JP 4-165041 A, JP 3-68939 B, JP 3-234594 A, JP 1-47545 B and JP 62-140894 A. Also known are the arts which have been described in JP 1-35910 B and JP 55-28874 B.

With regard to JIS1070 materials, the arts which have been proposed by the inventors of the present invention are described in JP 7-81264 A, JP 7-305133 A, JP 8-49034 A, JP 8-73974 A, JP 8-108659 A and JP 8-92679 A.

With regard to Al—Mg system alloys, the arts which have been proposed by the inventors of the present invention are described in JP 62-5080 B, JP 63-60823 B, JP 3-61753 B, JP 60-203496 A, JP 60-203497 A, JP 3-11635 B, JP 61-274993 A, JP 62-23794 A, JP 63-47347 A, JP 63-47348 A, JP 63-47349 A, JP 64-1293 A, JP 63-135294 A, JP 63-87288 A, JP 4-73392 B, JP 7-100844 B, JP 62-149856 A, JP 4-73394 B, JP 62-181191 A, JP 5-76530 B, JP 63-30294 A and JP 6-37116 B. The arts are also described in JP 2-215599 A and JP 61-201747 A.

With regard to Al—Mn system alloys, the arts which have been proposed by the inventors of the present invention are described in JP 60-230951 A, JP 1-306288 A and JP 2-293189 A. In addition, others are also described in JP 54-42284 B, JP 4-19290 B, JP 4-19291 B, JP 4-19292 B, JP 61-35995 A, JP 64-51992 A, JP 4-226394 A, U.S. Pat. No. 5,009,722, U.S. Pat. No. 5,028,276 or the like.

With regard to Al—Mn—Mg system alloys, the arts which have been proposed by the inventors of the present invention are described in JP 62-86143 A and JP 3-222796 A. In addition, others are also described in JP 63-60824 B, JP 60-63346 A, JP 60-63347 A, JP 1-293350 A, EP 223,737, U.S. Pat. No. 4,818,300, GB 1,222,777 or the like.

With regard to Al—Zr system alloys, the arts which have been proposed by the inventors of the present invention are described in JP 63-15978 B and JP 61-51395 A. In addition, others are also described in JP 63-143234 A, JP 63-143235 A, or the like.

With regard to Al—Mg—Si system alloys, the arts are described in GB 1,421,710.

The following method can be, for example, employed to prepare a plate from an aluminum alloy. First, purification treatment is performed on a molten aluminum alloy adjusted to a predetermined alloy component content and is cast according to a normal method. For the purification treatment, in order to remove unnecessary gases such as hydrogen from the molten metal, such treatment is performed as flux treatment; degassing treatment with argon gas, chlorine gas or the like; filtering treatment using a so-called rigid media filter such as ceramics tube filter, ceramics form filter or the like, a filter using alumina flake, alumina ball and the like as filtering media, or a glass cloth filter, or the like; or a combination of degassing treatment with filtering treatment.

It is preferable that purification treatment as aforementioned be performed to prevent defects caused by foreign matter such as non-metal inclusion in the molten metal and oxides, and defects caused by gasses dissolved in the molten metal. Filtering of a molten metal is described in JP 6-57432 A, JP 3-162530 A, JP 5-140659 A, JP 4-231425 A, JP 4-276031 A, JP 5-311261 A, JP 6-136466 A or the like. In addition, degassing of a molten metal is described in JP 5-51659 A, JP 5-49148 U or the like. The inventors of the present invention have also proposed an art regarding degassing of a molten metal in JP 7-40017 A.

Next, the molten metal to which purification treatment is performed as aforementioned is cast. Casting uses either a method by using a solid mold represented by DC casting method and a method by using a drive mold represented by continuous casting method.

In DC casting, a molten metal is solidified at a cooling rate within a range of 0.5 to 30° C./sec. If the cooling rate is less than 0.5° C./sec, many large intermetallic compounds may be formed. When DC casting is performed, an ingot plate 300 to 800 mm in thickness can be produced. Chipping is performed on this ingot according to a usual method as required, and normally, it is cut by 1 to 30 mm of the surface layer, and by 1 to 10 mm preferably. Before and after the chipping, soaking treatment is performed as required. If heat soaking treatment is performed, heat treatment is performed at 450 to 620° C. for 1 to 48 hours so as not to allow intermetallic compounds to become larger. If treatment time is shorter than 1 hour, an effect of soaking treatment may be insufficient.

Thereafter, hot rolling and cold rolling are performed to produce the rolled plate of an aluminum plate. It is appropriate that the starting temperature of hot rolling is 350 to 500° C. Before and after or halfway of hot rolling, intermediate annealing may be performed. The conditions of intermediate annealing are either a heating with a batch type annealer at 280 to 600° C. for 2 to 20 hours, more preferably at 350 to 500° C. for 2 to 10 hours, or a heating with continuous type annealer at 400 to 600° C. for 6 minutes or less, and more preferably at 450 to 550° C. for 2 minutes or less. Crystal structure can be fined by heating an aluminum plate with a continuous type annealer at a temperature rising speed of 10 to 200° C./sec.

With regard to an aluminum plate finished to a plate of a predetermined thickness, for example, 0.1 to 0.5 mm by the aforementioned processes, in addition, the flatness thereof may be improved with correcting device such as a roller leveler and a tension leveler. Although improvement of the flatness may be performed after the aluminum plate is cut into a sheet form, it is preferable that the improvement is performed in a continuous coil form to enhance its productivity. In addition, an aluminum plate is allowed to pass through a slitter line in order to process the aluminum plate to have a predetermined plate width. Further, an oil film may be provided on the surface of the aluminum plate to prevent generation of scratches due to friction between the aluminum plates. An oil film which is volatile or non-volatile is appropriately used as required.

On the other hand, methods to be industrially used as continuous casting method include two-roll method (Hunter method), method with cold rolling represented by 3C method, two-belt method (Hazellet method), a method using a cooling belt and a cooling block represented by Alysuisse caster II model. If continuous casting method is used, solidification develops at a cooling rate in a range of 100 to 1,000° C./sec. Continuous casting method is characterized by that the solid solubility percentage of an alloy component with respect to an aluminum matrix can be increased since it generally has a faster cooling speed than that of DC casting method. With regard to continuous casting method, the arts which have been proposed by the inventors of the present invention are described in JP 3-79798 A, JP 5-201166 A, JP 5-156414 A, JP 6-262203 A, JP 6-122949 A, JP 6-210406 A, JP 6-26308 A and the like.

If continuous casting method is performed, for example, with a method using a chill roll such as Hunter method or the like, since a cast plate of thickness 1 to 10 mm can be directly and continuously produced, resulting in a merit that hot rolling process can be omitted. In addition, if a method with a cooling belt such as Hazellet method or the like is used, a cast plate of thickness 10 to 50 mm can be produced. Generally, a continuously cast rolled-plate of thickness 1 to 10 mm can be obtained by disposing a hot roll just after casting to continuously roll a plate.

These continuously cast rolled plates are subjected to treatments such as cold rolling, intermediate annealing, improvement of flatness, treatment of slit and the like, and are finally finished into a predetermined thickness, for example, 0.1 to 0.5 mm. With regard to intermediate annealing and cold rolling conditions in case where continuous casting method is used, the arts which have been proposed by the inventors of the present invention are described in JP 6-220593 A, JP 6-210308 A, JP 7-54111 A, JP 8-92709 A and the like.

An aluminum plate thus manufactured is expected to have various characteristics as mentioned below.

It is preferable, regarding strength of an aluminum plate, 0.2% proof stress is 140 MPa or more to obtain an elasticity required as a support for a lithographic printing plate. In addition, it is preferable that 0.2% proof stress after heating treatment is performed at 270° C. for 3 to 10 minutes is 80 MPa or more, more preferably 100 Mpa or more in order to obtain an elasticity to some extent even if burning treatment is performed. Particularly, if an aluminum plate requires some elasticity, an aluminum material to which Mg or Mn is added can be adopted. Attachment of a plate to the plate cylinder of a printing machine, however, deteriorates if the elasticity is enhanced. For that reason, the material and an amount of the trace components to be added are appropriately selected in accordance with the application. In connection with this, the arts which have been proposed by the inventors of the present invention are described in JP 7-126820 A, JP 62-140894 A and the like.

Since the crystal texture of an aluminum plate surface may cause a defect in surface quality if chemical graining treatment or electrochemical graining treatment is performed on an aluminum plate, it is preferable that the crystal texture graining on the surface is not too coarse. The width of a particle of the crystal texture on the surface of an aluminum plate should preferably be 200 $\mu$m or less, more preferably be 100 $\mu$m or less, and further preferably be 50 $\mu$m or less. In addition, the length of a particle of the crystal texture should preferably be 5,000 $\mu$m or less, more preferably be 1,000 $\mu$m or less, and further preferably be 500 $\mu$m or less. In connection with these, the arts which have been proposed by the inventors of the present invention are described in JP 6-218495 A, JP 7-39906 A, JP 7-124609 A and the like.

Since a defect in surface quality may take place due to the uneven distribution of an alloy component on the surface of an aluminum plate if chemical graining treatment or electrochemical graining treatment is performed, it is preferable that the distribution of the alloy component is not too uneven on the surface. With regard to these, the arts which have been proposed by the inventors of the present invention are described in JP 6-48058 A, JP 5-301478 A, JP 7-132689 A and the like.

The size or density of intermetallic compounds in an aluminum plate may affect chemical graining treatment or electrochemical graining treatment. In connection with this, the arts which have been proposed by the inventors of the present invention are described in JP 7-138687 A, JP 4-254545 A and the like.

According to the present invention, for use, the aluminum plate as described above can be provided with asperities by laminating rolling, transfer or the like in the final rolling process.

An aluminum plate used in the present invention is a continuous belt-like sheet material or plate material. That is, an aluminum web is acceptable and a sheet material cut into a size or the like corresponding to a presensitized plate to be shipped as a product is also acceptable.

Since a scratch on the surface of an aluminum plate may become a defect when processed into a support for a lithographic printing plate, it is necessary to suppress as much as possible the generation of a scratch at a stage before a surface treatment process to produce a support for a lithographic printing plate is performed. For that reason, it is preferable that an aluminum plate is packed in a stable form and style so as to avoid being scratched.

In case of aluminum web, as a style of packing aluminum, for example, a hard board and a felt sheet are laid over a pallet made of iron, toroidal cardboards are put at both ends of a product, the entire product is wrapped with a polymer tube, a wooden toroid is inserted into the inner diameter section of a coil, the periphery of a coil is covered with a felt sheet, the product is fastened with a hoop iron and the indication is attached to its periphery. In addition, a polyethylene film can be used for packing material, and a needle felt and a hard board can be used for buffer. There are various packing forms besides this one. As long as it provides stable and scratch-free transportation or the like, packing is not limited to this method mentioned above.

The thickness of an aluminum plate used in the present invention is about 0.1 to 0.6 mm, preferably be 0.15 to 0.4 mm, and more preferably be 0.2 to 0.3 mm. This thickness can be appropriately changed according to the size of a printing machine, the size of a printing plate, the request of a user, or the like.

[Presensitized Plate]

The presensitized plate according to the present invention can be prepared by providing image recording layers such as photosensitive layers and thermosensitive layers as exemplified below on the aforementioned support for a lithographic printing plate.

<Image Recording Layer>

The image recording layer used in the present invention is not particularly limited, as long as the image recording layer is writable and the solubility thereof is lowered (hardened) by the irradiation of infrared laser.

The recording layer (thermosensitive layer) which is directly writable by the exposure of infrared laser and the solubility to an alkali developer in an exposed area is decreased, is hereinafter called "a thermal negative type recording layer (a thermosensitive layer) in an appropriate manner.

In the thermal negative type recording layer (thermosensitive layer), the polymerization reaction or cross linking reaction of a compound which constitutes a recording layer is triggered by a radical or an acid generated by the irradiation of light or heating as an initiator or a catalyst and is hardened to form an image area.

In the present invention, thermal negative type laser direct-writable model lithographic printing plate recording layers that are publicly known can be used. Cited for example are the recording layers (thermosensitive layer, photosensitive layer) as described in JP 09-87245 A, JP 09-43845 A and JP 07-306528 A.

The preferred thermal negative type recording layer (thermosensitive layer) is described in detail below.

<Thermal Negative Type>

A photopolymerizable-type layer is preferably cited as one of the thermal negative type (thermosensitive) layers. The photopolymerizable-type layer contains (A) infrared absorbent, (B) radical generator (radical polymerization initiator), and (C) radical polymerizable compound in which a polymerization reaction is triggered by a radical that is generated, and preferably further contains (D) binder polymer.

In the photopolymerizable-type layer, infrared rays absorbed by the infrared absorbent are converted into heat, radical polymerization initiators such as onium salts are decomposed by heat generated and the radical is generated. The radical polymerizable compound has at least one ethylenic unsaturated double bond, selected from a compound having at least one or preferably two or more ethylenic unsaturated bonds as the end group, a polymerization reaction is continuously triggered by the radical generated and the compound is hardened.

Besides the photopolymerizable-type layer, an acid cross-linkable-type layer is preferably cited as one of the thermal negative type (thermosensitive) layers. The acid cross-linkable-type layer contains (E) compound that generates acid by irradiating light or heating (hereinafter called "acid generator") and (F) compound that cross links by acid generated (hereinafter called "cross-linking agent"), and further contains (G) alkali-soluble high-molecular compound that may possibly react with the cross-linking agent in the presence of acid to form a layer which contains above compounds.

In the acid cross-linkable-type layer, acid generated by the irradiation of light or heat which decomposes an acid generator promotes the action of the cross-linking agent, a solid cross linking structure is formed between the cross-linking agents or between the cross-linking agent and the alkali-soluble high-molecular compound (binder polymer). Thereby alkali-solubility is lowered and the layer becomes insoluble in the developer. In this case, since the energy of infrared laser is efficiently used, (A) infrared absorbent is blended in the acid cross-linkable-type layer.

Besides the above-mentioned, as one of thermal negative type (thermosensitive) layers, also cited preferably is the thermosensitive layer where (H) hydrophobic thermoweldling resin particles are dispersed in a (J) hydrophilic polymer matrix, hydrophobic polymers can be welded by heat of an exposed area and a hydrophobic (ink-receptivity) area, namely, the image area is formed.

Various compounds used for photopolymerizable-type layer are described below.

(A) Infrared Absorbent

The infrared absorbent has a function to convert infrared rays absorbed into heat. Heat generated by the infrared absorbent decomposes the radical generator or the acid generator to generate the radical or acid. The infrared absorbent used in the present invention is dye or pigment having maximum absorption at a wavelength of 760 to 1,200 nm.

Commercially available dyes and publicly known ones as described in the references (e.g., "Dye Handbook" compiled by The Society of Synthetic Organic Chemistry, Japan, published in 1970) are available as dyes described above. Specifically, dyes as described in Paragraph Nos. [0050] to [0051] of JP 10-39509 A are cited as examples.

Cited as the most preferred ones are cyanine dye, squarylium dye stuff, pyrylium salts, nickel thiolate complex. Cyanine dye is preferred among others, particularly cyanine dye expressed by the following general formula (I) is most preferred.

General formula (I)

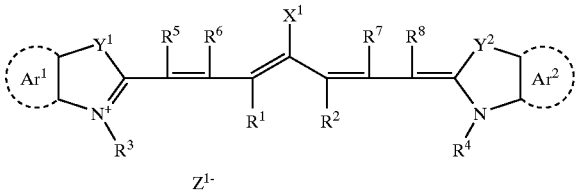

In the general formula (I), $X^1$ indicates halogen atom, $—X^2—L^1$ or $—N(L_2)(L_3)$. $X^2$ indicates oxygen atom or sulfur atom and $L^1$ indicates hydrocarbon group having the number of carbons 1 to 12. Each of $L_2$ and $L_3$ independently indicates hydrocarbon group having the number of carbons 1 to 20. Each of $R^1$ and $R^2$ independently indicates hydrocarbon group having the number of carbons 1 to 12. It is preferred that each of $R^1$ and $R^2$ is independently hydrocarbon group having the number of carbons 2 or more concerning the preservation and stability of the thermosensitive layer coating solution, and particularly it is most preferred that $R^1$ and $R^2$ are combined with each other to form a five-membered ring or a six-membered ring.

Each of $Ar^1$ and $Ar^2$ independently indicates aromatic hydrocarbon group which may have the substituent. Each of $Y^1$ and $Y^2$ independently indicates sulfur atom or dialkylmethylene group having the number of carbons 12 or less. Each of $R^3$ and $R^4$ independently indicates hydrocarbon group having the number of carbons 20 or less, which may have the substituent. Cited as preferred substituents are alkoxy group having the number of carbons 12 or less, carboxy group having the number of carbons 12 or less, and sulfo group having the number of carbons 12 or less. Each of $R^5$, $R^6$, $R^7$ and $R^8$ independently indicates hydrogen atoms or hydrocarbon group having the number of carbons 12 or less. It is preferred that they are hydrogen atoms from the viewpoint of the availability of a raw material.

$Z^{1-}$ indicates counter anion. However, if any one of $R^1$ to $R^8$ is substituted with sulfo group, $Z^{1-}$ is not required. It is preferred that, concerning preservation and stability of the thermosensitive layer solution, $Z^{1-}$ is halogen ion, perchlorate ion, tetrafluoroborate ion, hexafluorophosphate ion or sulfonic acid ion, and it is more preferred that $Z^{1-}$ is perchlorate ion, hexafluorophosphate ion or arylsulfonate ion.

In the present invention, cited as concrete examples of cyanine dyes expressed by the general formula (I) that can be preferably used are ones as described in Paragraph Nos. [0017] to [0019] of JP 2001-133969 A.

Available as pigments described above are commercially available pigments and ones as described in Color Index (C.I.) Handbook, "Latest Pigment Handbook" (edited by Japan Association of Pigment Technology, published in 1977), "Latest Pigment Applied Technology" (by CMC Publishing Co., Ltd., published in 1986) and "Printing Ink Technology" (by CMC Publishing Co., Ltd., published in 1984).

Cited as the kinds of pigment, for example, are black pigment, yellow pigment, orange pigment, brown pigment, red pigment, purple pigment, blue pigment, green pigment, fluorescent pigment, metal powder pigment and polymer bonding pigment. The details of these pigments are described in Paragraph Nos. [0052] to [0054] of JP 10-39509 A and these pigments can be applied to the present invention. The preferred pigment among them is carbon black.

It is preferred that the content of dye or pigment is 0.01 to 50 wt % with respect to the total solids of the thermosensitive layer, more preferred, 0.1 to 10 wt %. In addition, more preferred contents are 0.5 to 10 wt % for dye and 1.0 to 10 wt % for pigment.

If the content is less than 0.01 wt %, the sensitivity may be lowered and if the content exceeds 50 wt %, scum may occur to the non-image area when the lithographic printing plate is prepared.

(B) Radical Generator

Cited as radical generators for example are onium salts, organic boron complex, halomethylated triazine and particularly, onium salts are preferred. Cited specifically, for example, are iodonium salts, diazonium salts and sulfonium salts. Although these onium salts function as acid generators, they function as radical polymerization initiators if they are used with radical polymerizable compounds described later. In the present invention, preferably used onium salts are ones as expressed by the following general formulas (III) to (V).

$$Ar^{11}—I^{+}—Ar^{12}Z^{11-} \qquad \text{General formula (III)}$$

$$Ar^{21}—N^{+}N{\equiv}NZ^{21-} \qquad \text{General formula (IV)}$$

General formula (V)

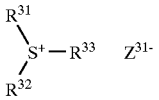

In the above general formula (III), each of $Ar^{11}$ and $Ar^{12}$ independently indicates aryl group having the number of carbons 20 or less, which may have the substituent. Cited as preferred substituents when this aryl group has the substituent are halogen atom, nitro group, alkyl group having the number of carbons 12 or less, alkoxy group having the number of carbons 12 or less and aryloxy group having the number of carbons 12 or less. $Z^{11-}$ indicates counter ion selected from a group consisting of halogen ion, perchlorate ion, tetrafluoroborate ion, hexafluorophosphate ion and sulfonic acid ion and $Z^{11-}$ is preferably perchlorate ion, hexafluorophosphate ion or arylsulfonate ion.

In the above general formula (IV), $Ar^{12}$ indicates aryl group having the number of carbons 20 or less, which may have the substituent. Cited as preferred substituents are halogen atom, nitro group, alkyl group having the number of carbons 12 or less, alkoxy group having the number of carbons 12 or less and aryloxy group having the number of carbons 12 or less, alkylamono group having the number of carbons 12 or less, dialkylamono group having the number of carbons 12 or less, arylamino group having the number of carbons 12 or less and diarylamino group having the number of carbons 12 or less. $Z^{21-}$ indicates counter ion with the same definition as in $Z^{11-}$.

In the above general formula (V), each of $R^{31}$, $R^{32}$ and $R^{33}$ independently indicates hydrocarbon group having the number of carbons 20 or less, which may have the substituent. Cited as preferred substituents are halogen atom, nitro group, alkyl group having the number of carbons 12 or less, alkoxy group having the number of carbons 12 or less and aryloxy group having the number of carbons 12 or less. $Z^{31-}$ indicates counter ion with the same definition as in $Z^{11-}$.

In the present invention, cited as the specific examples of onium salts preferably used are ones as described in Paragraph Nos. [0030] to [0033] of JP 2001-133969 A.

It is preferred that for the onium salts used in the present invention, the maximum absorption wavelength is up to 400 nm, and more preferred, up to 360 nm. The presensitized plate according to the present invention can be handled with a white light by setting the absorption wavelength at the ultraviolet-ray region like this.

It is preferred that the contents of these onium salts are 0.1 to 50 wt % with respect to the total solids of the thermosensitive layer, more preferred, 0.5 to 30 wt %, and further preferred, 1 to 20 wt %. If the content is less than 0.1 wt %, the sensitivity is lowered and if the content exceeds 50 wt %, scum may occur to a non-image area at the time of printing. Either only one kind or two kinds or more of these onium salts can be used. In addition, these onium salts may be added either to the same layer as that of other components or to another layer separately provided.

(C) Radical Polymerizable Compound

The radical polymerizable compound is the one which has at least one ethylenic unsaturated double bond and is selected from a compound which has at least one, preferably two or more ethylenic unsaturated bonds as the end group. Such compound groups are widely known in the industrial field and these compounds can be used in the present invention without particular limitation. These compounds have chemical forms of, for example, monomer, prepolymer (that is, dimer, trimer and oligomer), mixtures of these compounds, copolymers of these compounds and the like.

Cited as the examples of monomers and their copolymers are unsaturated carboxylic acids (e.g., acrylic acid, methacrylic acid, itaconic acid, crotonic acid, isocrotonic acid and maleic acid) and their esters and amides. It is preferred that esters of unsaturated carboxylic acids and aliphatic polyalcoholic compound, and amides of unsaturated carboxylic acids and aliphatic polyamine compound are used.

In addition, preferably used is additional reactant of unsaturated carboxylic acid esters and amides having nucleophilic substituents such as hydroxy group, amino group and mercapto group added with monofunctional or polyfunctional isocyanates or epoxide. Also used is dehydrated condensation reactant of unsaturated carboxylic acid esters and amides having nucleophilic substituents such as hydroxy group, amino group and mercapto group added with monofunctional or polyfunctional carboxylic acids, and the like. In addition, preferred is addition reactant of unsaturated carboxylic acid esters and amides having electrophilic substituents such as isocyanate group and epoxy group added with monofunctional or polyfunctional alcohols, amines or thiols. Further also preferred is substitution reactant of unsaturated carboxylic acid esters and amides having eliminative substituents such as halogen atom and tosyloxy group added with monofunctional or polyfunctional alcohols, amines or thiols. In addition, possibly used as other examples are compound groups where the above-mentioned unsaturated carboxylic acid is substituted with unsaturated phosphonic acids, styrene or the like.

Concrete examples of acrylic acid ester, methacrylic acid ester, itaconic acid ester, crotonic acid ester, isocrotonic acid ester and maleic acid ester that are radical polymerizable compounds that are esters of aliphatic polyalcoholic compound added with unsaturated carboxylic acid are described in Paragraph Nos. [0037] to [0042] of JP 2001-133969 A and these compounds can be also applied to the present invention.

Cited preferably as other esters are aliphatic alcohol esters as described in JP 46-27926 B, JP 51-47334 B and JP 57-196231 A, ones having aromatic skeleton as described in JP 59-5240 A, JP 59-5241 A and JP 2-226149 A and ones having amino group as described in JP 1-165613 A and the like.

Cited as specific examples of monomers of amides of aliphatic polyamine compounds with unsaturated carboxylic acid are methylenebis-acrylamide, methylenebis-methacrylamide, 1,6-hexamethylenebis-acrylamide, 1,6-hexamethylenebis-methacrylamide, diethylenetriamine-tris-acrylamide, xylylenebisacrylamide, xylylenebismethacrylamide and the like.

Cited as another preferred example of amide monomer is the one having a cyclohexylene skeleton as described in JP 54-21726 B.

In addition, urethane addition polymeric compound prepared by using addition reaction of isocyanate group with hydroxy group is also preferred, and cited as the specific examples are vinylurethane compound containing two or more polymerizable vinyl groups in one molecule where a vinyl monomer containing hydroxy group expressed by the following formula (VI) is added to a polyisocyanate compound having two or more isocyanate groups in one molecule as described in JP 48-41708 B.

$$CH_2{=}C(R^{41})COOCH_2CH(R^{42})OH \quad (VI)$$

(Where, $R^{41}$ and $R^{42}$ indicate H or $CH_3$ respectively.)

Also preferred are urethane acrylates as described in JP 51-37193 A, JP 2-32293 B and JP 2-16765 B and urethane compounds having an ethylene oxide skeleton as described in JP 58-49860 B, JP 56-17654 B, JP 62-39417 B and 62-39418 B.

Also preferred are radical polymerizable compounds having an amino skeleton or a sulfide skeleton in a molecule as described in JP 63-277653 A, JP 63-260909 A and JP 1-105238 A.

Cited as other examples are polyfunctional acrylates or methacrylates of epoxyacrylates where polyester acrylates or epoxy resin are allowed to react with (meth)acrylic acid as described in JP 48-64183 A, JP 49-43191 B and JP 52-30490 B. In addition, cited are specified unsaturated compounds as described in JP 46-43946 B, JP 1-40337 B and JP 1-40336 B and vinylphosphonic acid compounds as described in JP 2-25493 A. Further, in some cases, preferably cited is a skeleton having perfluoroalkyl group as described in JP 61-22048 A. Further cited are ones introduced as photo-curing monomer and oligomer on Pages 300 to 308 in the Journal vol. 20, No. 7 (1984) of The Adhesion Society of Japan.

The details of using these radical polymerizable compounds on in which skeleton they are to be used, whether they are to be used alone or in combination of two or more and how much they are to be added can be arbitrarily set in accordance with the performance design of the final recording material. For example, these are selected from the following viewpoints:

From the viewpoint of sensitivity, preferred is a skeleton that has a large number of unsaturated groups per one molecule and in many cases, preferred is more than two functions. In addition, a compound with more than three functions is better to increase the strength of the image area, namely a hardened layer. Further, effective is a method to control both photosensitivity and strength by using in combination compounds having different number of functions and different polymerizing groups (for example, acrylic acid ester compounds, methacrylic ester compounds, styrene compounds or the like). Although a compound with large molecular weight or a compound with high hydrophobicity is excellent in sensitivity and layer strength, there may be some undesirable cases in developing speed and deposition in the developer. In addition, the selection and using of the radical polymerizable compound are the important factors to compatibility with and dispersibility in other components (for example, binder polymer, initiators, coloring agent or the like) in the thermosensitive layer. For example, compatibility can be improved by using a low-purity compound or combining two or more compounds. In addition, a specified structure may be selected to improve the contact characteristics of the thermosensitive layer with the support, overcoated layer or the like. The larger the compound ratio of the radical polymerizable compound in an image recording layer is, the more advantageous it is in sensitivity. However, if the compound ratio is too excessive, undesirable phase separation may occur, a problem in a manufacturing process (for example, a defect in manufacturing attributable to the transfer of the recording layer component and adhesion) caused by the adhesiveness of the image recording layer may occur or a deposition may occur from the developer or the like.

From these points of view, in most cases, it is preferred that the compound ratio of the radical polymerizable compound is 5 to 80 wt % with respect to the total solids of the thermosensitive layer, and more preferred, 20 to 75 wt %. In addition, either a single compound or two or more compounds that are combined may be used. Besides the aforementioned, for the use of the radical polymerizable compound, a suitable skeleton, compound and added amount can be arbitrarily selected from the viewpoints of a degree of polymerization inhibition effect to oxygen, resolution, fogginess, variation of refractive index, surface adhesiveness or the like. A layer constitution and applying method such as undercoating or top coating can be conducted depending on the conditions.

(D) Binder Polymer

In the present invention, it is preferred that the binder polymer is further contained in the thermosensitive layer and that a linear organic polymer is used as the binder polymer. Any linear organic polymer may be used. A linear organic polymer that is soluble or has swelling property in water or weaker alkali solution is preferably selected to enable a water development or a development by aqueous weaker alkali solution. The linear organic polymer is selected and used not only as a layer forming agent to form the thermosensitive layer, but also selected and used in accordance with water or aqueous weaker alkali solution or in accordance with applications as an organic solvent developer. For example, the water development is enabled by using a water-soluble organic polymer. Cited as such linear organic polymers, radical polymers having carboxy group at a side chain are ones as described in, for example, JP 59-44615 A, JP 54-34327 B, JP 58-12577 B, JP 54-25957 B, JP 54-92723 A, JP 59-53836 A and JP 59-71048 A, namely, methacrylic acid copolymer, acrylic acid copolymer, itaconic acid copolymer, crotonic acid copolymer, maleic acid copolymer and partially-esterified maleic acid copolymer or the like. In addition, cited likewise is acid cellulose derivative having carboxy group at the side chain. Besides the foregoing, a polymer where cyclic acid anhydride is added to a polymer having hydroxy group, or the like is useful.

Particularly preferred among these linear organic polymers are (meth)acrylic resins having an ethylenically unsaturated double bond (e.g., an allyl group, a (meth)acryloyl group or a (meth)acrylamido group) and a carboxy group in the side chain, which have well-balanced layer strength, sensitivity and developability.

In addition, since urethane binder polymer containing acid group as described in JP 7-12004 B, JP 7-120041 B, JP 7-120042 B, JP 8-12424 B, JP 63-287944 A, JP 63-287947 A, JP 1-271741 A and JP 11-352691 A and the like is very excellent in strength, the polymer is advantageous in press life and low exposure suitability.

Further, besides the foregoing, as the water-soluble linear organic polymer, polyvinyl pyrrolidone, polyethylene oxide and the like are useful. In addition, alcohol-soluble nylon, polyether of 2,2-bis-(4-hydroxyphenyl) propane with epichlorohydrin, and the like are useful to increase the strength of a hardened layer.

Weight average molecular weight of the linear organic polymer used in the present invention is preferably 5000 or more, and more preferably, 10,000 to 300,000. Also, number average molecular weight is preferably 1000 or more, and more preferably, 2000 to 250,000. Degree of dispersion (weight average molecular weight/number average molecular weight) is preferably 1 or more, and more preferably, 1.1 to 10.

Although these linear organic polymers may be any of random copolymer, block copolymer, graft copolymer or the like, but preferred is random copolymer.

These linear organic polymers can be synthesized by a publicly known conventional method. Cited as solvents used for synthesis for example are tetrahydrofuran, ethylenedichloride, cyclohexanone, methyl ethyl ketone, acetone, methanol, ethanol, ethyleneglycol monomethyl ether, ethyleneglycol monoethyl ether, 2-methoxyethyl acetate, diethyleneglycol dimethyl ether, 1-metoxy-2-propanol, 1-metoxy-2-propylacetate, N,N-dimethylformamide, N,N-dimethylacetamide, toluene, ethyl acetate, methyl lactate, ethyl lactate, dimethylsulfoxide, water or the like. These solvents may be used either singly or by combining two or more kinds.

Publicly known compounds such as azo initiator and peroxide initiator can be used as the radical polymerization initiators used to synthesize these linear organic polymers.

The binder polymer may be used either singly or in the form of mixing with others. It is preferred that the content of the binder polymer is 20 to 95 wt % with respect to the total solids of the thermosensitive layer, and more preferred, 30 to 90 wt %. If the content is less than 20 wt %, the strength of the image area is insufficient when the image area is formed. In addition, If the content exceeds 95 wt %, the formation of the image area may not occur. In addition, it is preferred that mass ratio of radical polymerizable compound to linear organic polymer is 1/9 to 7/3.

Next, description is made as follows for each compound used for acid cross-linkable-type layer.

(A) Infrared Absorbent

For the infrared absorbent included acid cross-linkable-type layer as required, the same infrared absorbent as that (A) as described in the above photopolymerizable-type layer can be used.

It is preferred that the content of an infrared absorbent is 0.01 to 50 wt % with respect to the total solids of the thermosensitive layer, and more preferred, 0.1 to 10 wt %. Further, more preferred contents are 0.5 to 10 wt % for dye, and 1.0 to 10 wt % for pigment.

If the content is less than 0.01 wt %, the sensitivity may be lowered, and if it exceeds 50 wt %, scum may occur to the non-image area when the lithographic printing plate is prepared.

(E) Acid Generator

The acid generator is a compound that generates acid by irradiating light with wavelength of 200 to 500 nm or heating at 100° C. or higher.

Cited as acid generators are publicly known compounds and their mixtures of publicly known acid generators used for photo initiator of photo cation polymerization, photo initiator of photo radical polymerization, photo decoloring agent, photo discoloring agent, micro resist or the like that may be thermally decomposed to generate acid; and a compound or the like where a group or a compound that generates acid is introduced into the main chain or side chain of polymer.

Concretely cited are diazonium salts as described in S. I. Schlesinger, Photogr, Sci, Eng., 18,387 (1974), T. S. Bal et al., Polymer, 21,423 (1980), ammonium salts as described in U.S. Pat. No. 4,069,055, JP 4-365049 A and the like, phosphonium salts as described in U.S. Pat. No. 4,069,055 and U.S. Pat. No. 4,069,056, iodonium salts as described in EP 104,143 B, U.S. Pat. No. 339,049, U.S. Pat. No. 410,201, JP 2-150848 A and JP 2-296514 A and sulfonium salts as described in EP 370,693 B, EP 390,214 B, EP 233,567 B, EP 297,443 B, EP 297,442 B, U.S. Pat. No. 4,933,377, U.S. Pat. No. 161,811, U.S. Pat. No. 410,201, U.S. Pat. No. 339,049, U.S. Pat. No. 4,760,013, U.S. Pat. No. 4,734,444, U.S. Pat. No. 2,833,827, DE 2,904,626 B, DE 3,604,580 B and DE 3,604,581 B.

In addition, selenonium salts as described in J. V. Crivello et al., Macromolecules, 10(6), 1307 (1977), J. V. Crivello et al., J. Polymer Sci., Polymer chem. Ed., 17, 1047 (1979), onium salts such as arsonium salts or the like as described in C. S. Wen et al., Teh, Proc. Conf. Rad. Curing ASIA, p 478 Tokyo, October (1988), organic halides as described in U.S. Pat. No. 3,905,815, JP 46-4605 B, JP 48-36281 A, JP 55-32070 A, JP 60-239736 A, JP 61-169835 A, JP 61-169837 A, JP 62-58241 A, JP 62-212401 A, JP 63-70243 A and JP 63-298339 A, organic metals/organic halides as described in JP 2-161445 A, acid generator by irradiating light having o-nitrobenzyl protective group as described in EP 0,290,750 B, EP 046,083 B, EP 156,535 B, EP 271,851 B, EP 0,388,343 B, U.S. Pat. No. 3,901,710, U.S. Pat. No. 4,181,531, JP 60-198538 A and JP 53-133022 A, compounds that are photo decomposed to generate sulfonic acid represented by iminosulfonate or the like as described in EP 0,199,672 B, EP 84,515 B, EP 199,672 B, EP 044,115 B, EP 0,101,122 B, U.S. Pat. No. 4,618,564, U.S. Pat. No. 4,371,605, U.S. Pat. No. 4,431,774, JP 64-18143 A, JP 2-245756 A and JP 04-365048 A and disulfonates as described in JP 61-166544 A.

Further, preferably cited also are compounds where these groups or compounds that generate acid are introduced into the main chain or side chain of a polymer. Cited for example are compounds as described in U.S. Pat. No. 3,849,137, DE 3,914,407 B, JP 63-26653 A, JP 55-164824 A, JP 62-69263 A, JP 63-146037 A, JP 63-163452 A, JP 62-153853 A and JP 63-146029 A.

In addition, further cited are compounds that generate acid by irradiating light as described in V. N. R. Pillai, Synthesis, (1), 1 (1980), A. Abad et al., Tetrahedron Lett., (47) 4555 (1971), D. H. R. Barton et al., J. Chem. Soc., (B), 329 (1970), U.S. Pat. No. 3,779,778 and EP 126,712 B.

Among the aforementioned, preferred as acid generators are compounds expressed by the following formulas (I) to (V).

(I)

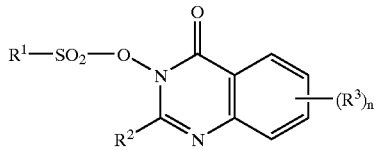

(II)

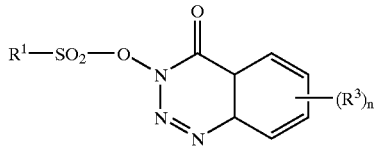

(III)

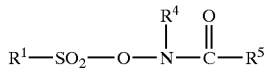

(IV)

$Ar^1—SO_2—SO_2—Ar^2$ (V)

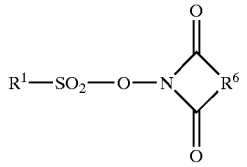

In the above formula (I) to (V), each of $R^1$, $R^2$, $R^4$ and $R^5$ independently indicates hydrocarbon group having the number of carbons 20 or less that may have the substituent. $R^3$ indicates halogen atom, hydrocarbon group having the number of carbons 10 or less, which may have the substituent, or alkoxy group having the number of carbons 10 or less, which may have the substituent. Each of $Ar^1$ and $Ar^2$ independently indicates aryl group having the number of carbons 20 or less, which may have the substituent. $R^6$ indicates bivalent hydrocarbon group having the number of carbons 20 or less, which may have the substituent. n indicates the integer of 1 to 4.

It is preferred that each of $R^1$, $R^2$, $R^4$ and $R^5$ is hydrocarbon group having the number of carbons 1 to 14.

The preferred embodiment of the acid generator expressed by the above formulas (I) to (V) is described in detail in Paragraph Nos. [0197] to [0222] of JP 2001-142230 A filed by the applicant of the present invention. These compounds can be synthesized by the methods as described, for example, in JP 2-100054 A and JP 2-100055 A.

In addition, onium salts where halides, sulfonic acid and the like are counter ion can be used as acid generators. Among them, preferably cited is a compound that has any of the structural formulas of iodonium salts, sulfonium salts and diazonium salts expressed by the following general formulas (VI) to (VIII).

$Ar^3—I^+—Ar^4X^-$ General formula (VI)

General formula (VII)

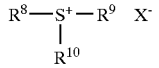

$Ar^3—N_2^+X^-$ General formula (VIII)

In the above general formulas (VI) to (VIII), $X^-$ indicates halide ion, $ClO_4^-$, $PF_6^-$, $SbF_6^-$, $BF^{4-}$ or $R^7SO_3^-$. Here, $R^7$ indicates hydrocarbon group having the number of carbons 20 or less which may have the substituent. Each of $Ar^3$ and $Ar^4$ independently indicates aryl group having the number of carbons 20 or less which may have the substituent. Each of $R^8$, $R^9$ and $R^{10}$ independently indicates hydrocarbon group having the number of carbons 18 or less which may have the substituent.

Onium salts as such are described as compounds expressed by the general formulas (I) to (III) in Paragraph Nos. [0010] to [0035] of JP 10-39509 A.

It is preferred that the content of the acid generator is 0.01 to 50 wt % with respect to the total solids of the thermosensitive layer, more preferred, 0.1 to 25 wt %, and further preferred, 0.5 to 20 wt %.

If the content of the acid generator is less than 0.01 wt %, the image may not be formed and if it exceeds 50 wt %, scum may occur to the non-image area at the time of printing when the lithographic printing plate is prepared.

The acid generator may be used either singly or by combining two or more kinds.

(F) Cross-Linking Agent

The following are cited as cross-linking agents.

(i) Aromatic compounds where hydroxymethyl group or alkoxymethyl group is substituted (ii) Compounds having N-hydroxymethyl group, N-alkoxymethyl group or N-acyloxymetyl group (iii) Epoxide The compounds in the aforementioned (i) to (iii) are detailedly described.

(i) Cited for example as aromatic compounds where hydroxymethyl group or alkoxymethyl group is substituted are aromatic compounds or heterocyclic compounds where hydroxymethyl group, acetoxymethyl group or alkoxymethyl group is poly-substituted. But, resinoid compounds where phenols known as resol and aldehydes are polycondensated under the basic conditions are also included.

A preferred compound is the one that has hydroxymethyl group or alkoxymethyl group at a position adjacent to hydroxy group among aromatic compounds or heterocyclic compounds where hydroxymethyl group or alkoxymethyl group is poly-substituted.

In addition, a further preferred compound is the one with alkoxymethyl group having the number of carbons 18 or less among aromatic compounds or heterocyclic compounds where alkoxymethyl group is poly-substituted and more preferred is a compound expressed by the following general formulas (1) to (4).

General formula (1)

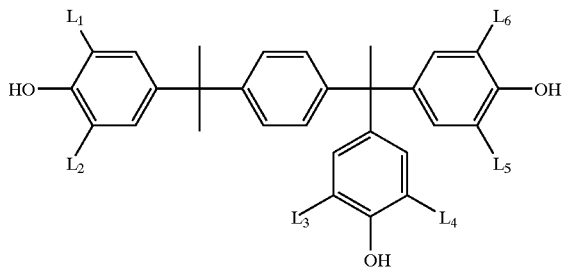

-continued

General formula (2)

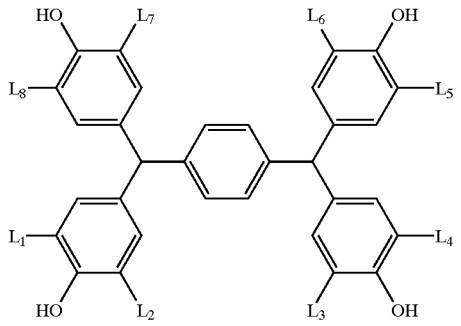

General formula (3)

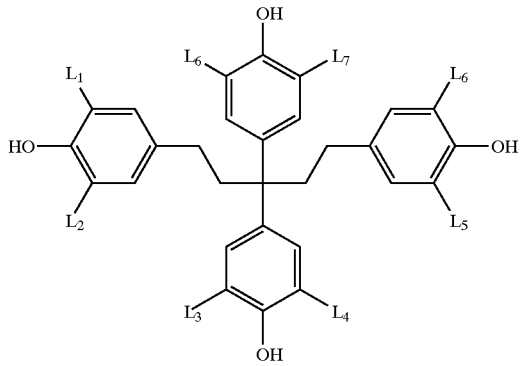

General formula (4)

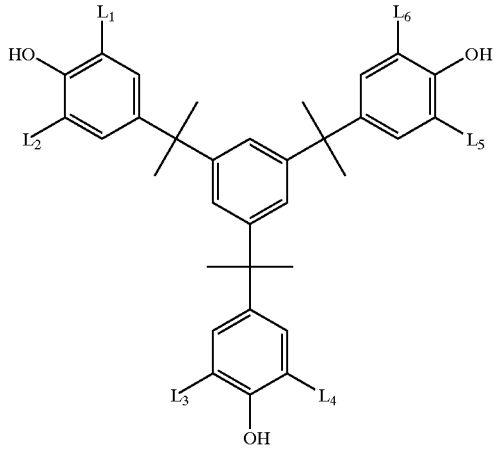

In the above general formulas (1) to (4), each of $L_1$ to $L_8$ independently indicates alkoxymethyl group where alkoxy group having the number of carbons 18 or less such as hydroxymethyl, methoxymethyl or ethoxymethyl group is substituted.

These cross-linking agents are preferred since cross linking efficiency is high and press life can be improved.

(ii) Cited as a compound having N-hydroxymethyl group, N-alkoxymethyl group or N-acyloxymethyl group are monomer or oligomer of melamine-formaldehyde condensate and urea-formaldehyde condensate as described in EP 0,133,216 A, DT 3,634,671 B and DT 3,711,264 B, compounds substituted by alkoxy group as described in EP 0,212,482 A and the like.

Among others, preferred is a melamine-formaldehyde derivative having at least two free N-hydroxymethyl groups, N-alkoxymethyl groups or N-acyloxymethyl groups and more preferred is N-alkoxymethyl derivative, for example.

(iii) Cited as epoxides are epoxides such as monomer, dimer, oligomer and polymer having one or more epoxy groups. Cited for example are reaction product of bisphenol A with epichlorohydrin and reaction product of low molecular-weight phenol-formaldehyde resin with epichlorohydrin.

Besides the foregoing, cited are epoxy resin as described in U.S. Pat. No. 4,026,705 and GB 1,539,192 B.

It is preferred that the content when the compounds in items (i) to (iii) are used as cross-linking agents is 5 to 80 wt % with respect to the total solids of the thermosensitive layer, more preferred is 10 to 75 wt % and further preferred is 20 to 70 wt %.

If the added amount of a cross-linking agent is less than 5 wt %, the durability of the thermosensitive layer obtained by an image recording material may deteriorate and if it exceeds 80 wt %, stability at the time of storage may lower.

In the present invention, (iv) a phenol derivative expressed by the following general formula (5) can be preferably used as cross-linking agent.

General formula (5)

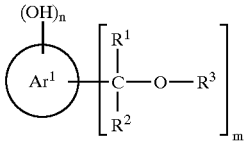

In the above general formula (5), $Ar^1$ indicates an aromatic hydrocarbon ring which may have the substituent.

It is preferred that the above aromatic hydrocarbon ring is benzene ring, naphthalene ring or anthracene ring from the viewpoint of availability of a material. In addition, it is preferred that the above-mentioned substituent is halogen atom, hydrocarbon group having the number of carbons 12 or less, alkoxy group having the number of carbons 12 or less, alkylthio group having the number of carbons 12 or less, cyano group having the number of carbons 12 or less, nitro group having the number of carbons 12 or less, trifluoromehyl group having the number of carbons 12 or less or the like.

Among the mentioned above, it is more preferred that $Ar^1$ is benzene ring or naphthalene ring that have no substituent; benzene ring or naphthalene ring having substituents such as halogen atom, hydrocarbon group having the number of carbons 6 or less, alkoxy group having the number of carbons 6 or less, alkylthio group having the number of carbons 6 or less and nitro group having the number of carbons 6 or less, from the viewpoint of improved sensitivity.

Each of $R^1$, $R^2$ and $R^3$ independently indicates hydrogen atom or hydrocarbon group having the number of carbons 12 or less. It is preferred that each of $R^1$, $R^2$ and $R^3$ is hydrogen atom on methyl group.

Each of m and n independently indicates the integer of 1 to 8.

(G) Alkali-Soluble High-Molecular Compound

Cited as alkali-soluble high-molecular compounds are novolak resin, a polymer having hydroxyaryl group and the like at its side chain. Cited as novolak resin is resin where phenols and aldehydes are condensed under an acidic condition.

Among them, preferred are novolak resin obtained from phenol and formaldehyde, novolak resin obtained from m-cresol and formaldehyde, novolak resin obtained from p-cresol and formaldehyde, novolak resin obtained from o-cresol and formaldehyde, novolak resin obtained from octylphenol and formaldehyde, novolak resin obtained from m-/p-mixed cresol and formaldehyde, novolak resin obtained from a mixture of phenol/cresol (any of m-, p-, o-, m-/p-mixing, m-/o-mixing and o-/p-mixing) and formaldehyde, a high-molecular weight novolak resin with high ortho binding fraction obtained by allowing the materials of phenol and paraformaldehyde to react with each other at a high pressure under a sealed condition dispensing with a catalyst, and the like.

It is preferable to use a suitable novolak resin selected from those having a weight average molecular weight of 800 to 300,000 and a number average molecular weight of 400 to 60,000 in accordance with a specific purpose.

In addition, a polymer having hydroxyaryl group at its side chain is preferably used alike novolak resin. Cited as the above hydroxyaryl group is aryl group where one or more hydroxy groups are bonded. It is preferred that the above aryl group is, for example, phenyl group, naphthyl group, anthracenyl group, phenanthrenyl group and the like. Among others, preferred is phenyl group and naphthyl group from the viewpoint of easy availability and the physical properties.

Cited as the concrete examples of polymers having hydroxyaryl group at its side chain are polymers containing either one kind of the constituting units expressed by the following formulas (IX) to (XII). The present invention is not, however, limited to these compounds.

(IX)

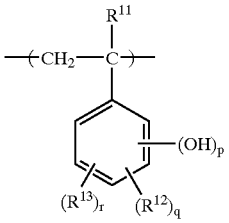

(X)

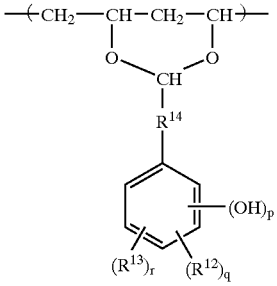

(XI)

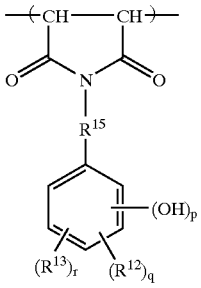

-continued (XII)

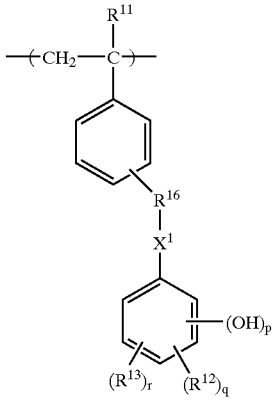

In the above formulas (IX) to (XII), $R^{11}$ indicates hydrogen atom or methyl group. Each of $R^{12}$ and $R^{13}$ independently indicates hydrogen atom, halogen atom, hydrocarbon group having the number of carbons 10 or less, alkoxy group having the number of carbons 10 or less or aryloxy group having the number of carbons 10 or less. $R^{12}$ and $R^{13}$ may be ring condensed by mutually boding them to form benzene ring, cyclohexane ring and the like. $R^{14}$ indicates a single bond or bivalent hydrocarbon group having the number of carbons 20 or less. $R^{15}$ indicates a single bond or bivalent hydrocarbon group having the number of carbons 20 or less. $R^{16}$ indicates a single bond or bivalent hydrocarbon group having the number of carbons 10 or less. $X^1$ indicates a single bond, ether linkage, thioether linkage, ester linkage or amide bonding. P indicates the integer of 1 to 4. Each of q and r independently indicates the integer of 0 to 3.

An alkali-soluble high-molecular compound is detailedly described in Paragraph Nos. [0130] to [0163] of JP 2001-142230 A filed by the applicant of the present invention.

The alkali-soluble high-molecular compound may be used either singly or in the form of two or more kinds combined with each other.

It is preferred that the content of the alkali-soluble high-molecular compound is 5 to 95 wt % with respect to the total solids of the thermosensitive layer, more preferred is 10 to 95 wt % and further preferred is 20 to 90 wt %.

If the content of an alkali-soluble resin is less than 5 wt %, the durability of the thermosensitive layer may deteriorate and if it exceeds 95 wt %, an image may not be formed.

In addition, besides the acid cross-linkable-type layer as mentioned above, the materials which can be used are negative type image recording materials containing phenol derivatives as described in JP 8-276558 A, negative type recording materials containing diazonium compounds as described in JP 7-306528 A and negative type image formation materials that utilize a cross linking reaction with an acid catalyst, by using a polymer having heterocyclic group with an unsaturated bond in a ring as described in JP 10-203037 A and the like.

Next, each compound employed for the thermosensitive layer using (H) hydrophobic thermowelding resin particles and (J) hydrophilic polymer matrix is described below.

(H) Hydrophobic Thermowelding Resin Particles

It is preferred that for hydrophobic thermowelding resin particles (hereinafter referred to as "particulate polymer"), particulate polymers fuse together into a mass by heating and more preferred is a grain of which surface is hydrophilic and that disperses into hydrophilic components such as fountain solution.

Preferably cited as resins for forming particulate polymers for example are polyethylene, polystyrene, polyvinyl chloride (PVC), polyvinylidene chloride, polymethyl (meth) acrylate, polyethyl (meth)acrylate, polybutyl (meth)acrylate, polyacrylonitrile, polyvinyl acetate; latex of their copolymers and the like.

The particulate polymer having a hydrophilic surface includes the following three types: the polymer constituting a particulate is hydrophilic; the polymer is made hydrophilic by introducing a hydrophilic group into the main chain or side chain of the polymer or by another operation; and the surface of the particulate polymer is made hydrophilic by allowing a hydrophilic polymer such as polyvinyl alcohol or polyethylene glycol, a hydrophilic oligomer or a hydrophilic low molecular-weight compound to adsorb on the surface of the particulate polymer. However, the particulate polymer is not limited to these types.

From the viewpoint that the layer strength of the image area is improved, another preferred feature of the particulate polymer is that the particulate polymer is composed of a polymer having thermal reactive functional group.

Cited as the thermal reactive functional groups are ethylenic unsaturated group (for example, acryloyl group, metacryloyl group, vinyl group, allyl group and the like) that performs polymerization reaction; isocyanate group or its blocked type that performs addition reaction, functional group (for example, amino group, hydroxy group, carboxy group and the like) having active hydrogen atom that is the reaction object thereof; epoxy group that performs addition reaction, amino group, carboxy group or hydroxy group that is the reaction object thereof; carboxy group and hydroxy group or amino group that performs condensation reaction; acid anhydride that performs ring-opening addition reaction and amino group or hydroxy group and the like. However, if a group has a function that a chemical bond is formed by heating, a functional group that performs any reactions may be acceptable. These thermal reactive functional groups may be introduced into particulate polymer either at the time of polymerization or by using high polymer reaction after polymerization.

It is preferred that the content of the particulate polymer is 50 wt % or more with respect to the total solids of the thermosensitive layer and more preferred is 60 to 95 wt %.

If the particulate polymer having a thermal reactive functional group as above is used for the thermosensitive layer, a compound that initiates or promotes these reactions may be added as required. Cited as a compound that initiates or promotes a reaction is a compound that is likely to generate a radical or a cation by heating. Concretely cited are lophine dimer, trihalomethyl compound, peroxide, azo compound, onium salts containing diazonium salts or diphenyliodonium salts, acylphosphine, imidosulfonate and the like.

It is preferred that the contents of these compounds are 1 to 20 wt % with respect to the total solids of the thermosensitive layer and more preferred is 3 to 10 wt %. If the content remains within the above range, development property on a printing press is not impaired even when a development is performed on a printing press, thus a good reaction initiation effect or a reaction promotion effect can be obtained.

(J) Hydrophilic Polymer Matrix

For the above particulate polymer, a development property on a printing press is better when a development is performed on the printing press by dispersing the particulate polymer in a matrix composed of a hydrophilic resin and the layer strength of a thermal sensitivity per se is also improved.

It is preferred that the hydrophilic resin has hydrophilic groups such as hydroxy group, carboxy group, hydroxyethyl group, hydroxypropyl group, amino group, aminoethyl group, aminopropyl group and carboxymethyl group, for example.

Cited as concrete examples of hydrophilic resins are gum arabic, casein, gelatin, starch derivative, carboxymethylcellulose and its sodium salts, cellulose acetate, sodium alginate, vinyl acetate-maleic acid copolymers, styrene-maleic acid copolymers, polyacrylic acids and their salts, polymethacrylic acids and their salts, homopolymer and copolymer of hydroxyethylmethacrylate, homopolymer and copolymer of hydroxyethylacrylate, homopolymer and copolymer of hydroxypropylmethacrylate, homopolymer and copolymer of hydroxypropylacrylate, homopolymer and copolymer of hydroxybutylmethacrylate, homopolymer and copolymer of hydroxybutylacrylate, polyethylene glycols, hydroxypropylene polymers, polyvinyl alcohol, hydrolyzed polyvinyl acetate in which the degree of hydrolysis is at least 60 wt % and preferably at least 80 wt %, polyvinyl formal, polyvinyl butyral, polyvinyl pyrrolidone, homopolymer and copolymer of acrylamide, homopolymer and copolymer of methacrylamide and homopolymer and copolymer of N-methylolacrylamide.

It is preferred that the content of the hydrophilic resin is 5 to 40 wt % with respect to the total solids of the thermosensitive layer and more preferred is 10 to 30 wt %. If the content remains within the range, a better development property on a printing press can be obtained when a development is performed on the printing press and a better layer strength can be also obtained.

Image recording by an infrared laser irradiation or the like is possible by allowing (A) the infrared absorbent as mentioned above to be contained in the thermosensitive layer using (H) hydrophobic thermowelding resin particles and (J) hydrophilic polymer matrix as described above.

The infrared absorbent used is the same one as exemplified above and the content of the infrared absorbent is preferably 30 wt % or less with respect to the total solids of the thermosensitive layer, more preferred is 5 to 25 wt % and further preferred is 7 to 20 wt %. If the content remains within the above range, higher sensitivity can be achieved.

(K) Other Components

Various compounds may be further added to the (thermal negative type) thermosensitive layer as required besides each component as mentioned above.

For example, dye that has a large absorption in a visible light area can be used as the coloring agent for an image. Preferably used also as coloring agents are pigments such as phthalocyanine pigment, azo pigment, carbon black, titanium oxide and the like. It is desirable that these coloring agents are added since the image area and the non-image area can be discriminated after the image is formed. The content of the coloring agent is 0.01 to 10 wt % with respect to the total solids of the thermosensitive layer.

In addition, if the thermosensitive layer is the photopolymerizable-type layer, it is preferred that a small amount of thermal polymerization inhibitor is added to prevent the unnecessary thermal polymerization of the radical polymerizable compound while a coating solution is prepared and stored.

Cited as preferred thermal polymerization inhibitors are hydroquinone, p-methoxyphenol, di-t-butyl-p-cresol, pyrogallol, t-butylcatechol, benzoquinone, 4,4'-thiobis(3-methyl- 6-t-butylphenol), 2,2'-methylenebis(4-methyl-6-t-butylphenol), N-nitroso-N-phenylhydroxylaminealuminum salts and the like.

It is preferred that the content of the thermal polymerization inhibitor is about 0.01 to about 5 wt % with respect to the total solids of the thermosensitive layer.

In addition, higher fatty acid derivatives such as behenic acid or behenic acid amide are added to prevent polymerization inhibition caused by oxygen as required and the derivative may be maldistributed on the surface of the thermosensitive layer in a drying process after coating. It is preferred that the content of the higher fatty acid derivative is about 0.1 to about 10 wt % with respect to the total solids of the thermosensitive layer.

Further, the thermosensitive layer may contain an elasticizer to give a flexibility to a layer or the like as required. Used for example are polyethylene glycol, tributyl citrate, diethyl phthalate, dibutyl phthalate, dihexyl phthalate, dioctyl phthalate, tricresyl phosphate, tributyl phosphate, trioctyl phosphate, tetrahydrofurfuryl oleate and the like.

Various components as mentioned above are dissolved in a solvent and a solution is to be applied on a support for a lithographic printing plate to obtain the presensitized plate according to the present invention by providing the above thermosensitive layer.

Although cited as solvents used here are ethylenedichloride, cyclohexanone, methyl ethyl ketone, methanol, ethanol, propanol, ethyleneglycolmonomethylether, 1-methoxy-2-propanol, 2-methoxyethyl acetate, 1-methoxy-2-propylacetate, dimethoxyethane, methyl lactate, ethyl lactate, N,N-dimethylacetamide, N,N-dimethylformamide, tetramethylurea, N-methylpyrrolidone, dimethylsulfoxide, sulfolane, γ-butyllactone, toluene, water and the like, the solvents according to the present invention are not limited to these solvents. Either a solvent may be singly used or mixed solvents may be used. The concentration of the various components as mentioned above in a solvent is preferably 1 to 50 wt %.

Nonionic surfactants as described in JP 62-251740 A and JP 3-208514 A and ampholytic surfactants as described in JP 59-121044 A and JP 4-13149 A can be added to a coating solution for the thermosensitive layer to increase the stability of development process with respect to the development conditions.

Cited as concrete examples of nonionic surfactants are sorbitantristearate, sorbitanmonopalmitate, sorbitantriolate, monoglyceride stearate, polyoxyethylenenonylphenylether and the like.

Cited as concrete examples of ampholytic surfactants are alkyldi(aminoethyl)glycine, alkylpolyaminoethylglycinehydrochloride, 2-alkyl-N-carboxyethyl-N-hydroxyethylimidazolinium betaine, N-tetradecyl-N,N-betaine type (for example, trade name: Amogen K made by Dai-ichi Kogyo Seiyaku Co., Ltd.) and the like.

It is preferred that the percentage of the above nonionic surfactant and ampholytic surfactant in the thermosensitive layer coating solution is 0.05 to 15 wt % with respect to the total solids of the thermosensitive layer respectively and more preferred is 0.1 to 5 wt %.

Besides each compound mentioned above, various publicly known additives can be further used for the thermosensitive layer according to the present invention as required.

These compounds are dissolved in a preferred solvent to prepare the thermosensitive layer coating solution and the presensitized plate according to the present invention can be obtained by spreading the solution on the support having a specified surface shape as mentioned above.

It is preferred that the spread amount (solid) of the thermosensitive layer obtained by coating and drying is normally 0.5 to 5.0 g/m$^2$ although it varies with applications.

Cited as coating methods for example are bar coater coating, rotation coating, spray coating, curtain coating, dip coating, air knife coating, blade coating, roll coating and the like although many methods can be used. As a spread amount decreases, the film characteristics of the thermosensitive layer that functions as the image recording layer deteriorate although an apparent sensitivity increases.

[Overcoating Layer]

In the present invention, an overcoating layer can be formed. In this case, as the overcoating layer any publicly known layer can be selected and used without particular limitation as long as it is transparent to an active light, namely, to a light used for an image exposure and the layer has a certain adhesion with an adjacent thermosensitive layer.

The overcoating layer like this is formed to inhibit an influence from the air outside to a compound in the thermosensitive layer and a compound generated by the exposure to an active light. For this purpose, it is preferred that the layer has such properties that a low molecular-weight compound existent in the air and a low molecular-weight compound generated in the thermosensitive layer are hardly permeated. Namely, the overcoating layer may be any substance that traps a compound generated in the thermosensitive layer when exposure is performed or any substance that can prevent the contamination of the thermosensitive layer with water, bases and acids existent in the air and compounds of oxygen and the like that inhibit a reaction generated in the thermosensitive layer and further if the overcoating layer in the non-image area can be removed before development or during development. Namely, preferred is a low-gas-permeability film or substance that forms a layer.

Concretely cited as compounds that form the overcoating layer are polyvinyl alcohol, polyvinylidene chloride, poly(meth)acrylonitrile, polysulfone, acethyl cellulose, polyvinyl chloride, polyvinyl acetate, ethylene-vinylalcohol copolymer, polyethylene, polycarbonate, polystyrene, polyethylene, polyamide, cellophane, acrylic resin, gelatin, gum arabic and the like. These compounds may be used either singly or in the form of combined with each other. Cited as more preferred compounds are polyvinyl alcohol that is a water-soluble polymer, a water-soluble acrylic resin, polyvinyl pyrrolidone, gelatin, gum arabic and the like from the viewpoint of a fact that they can be easily removed at the time of development and can be easily painted. It is more preferred that polyvinyl alcohol, polyvinyl pyrrolidone, gelatin, gum arabic that can be applied by using water as a solvent and can be removed with a water type developer are used and it is also proper to use a nitrogenous water-soluble polymer having a partial skeleton of amines and the like and a water-soluble polymer having acid group such as sulfonic acid, together with the aforementioned water-soluble polymers in order to improve the removing properties thereof.

With respect to a polyvinyl alcohol used for the overcoating layer according to the present invention, ester, ether and acetal may be partially substituted if the polyvinyl alcohol merely has unsubstituted vinyl alcohol unit with a substantial amount having a required water-solubility. In addition, a polyvinyl alcohol may partially have other copolymer components likewise. Cited as concrete examples of polyvinyl alcohol are compounds that are hydrolyzed at 71 to 100% and whose polymerization degrees lie in a range of 300 to 2,400. Concretely cited are (trade names) PVA-105, PVA- 110, PVA-117, PVA-117H, PVA-120, PVA-124, PVA-124H, PVA-CS, PVA-CST, PVA-HC, PVA-203, PVA-204, PVA-205, PVA-210, PVA-217, PVA-220, PVA-224, PVA-217EE, PVA-217E, PVA-220E, PVA-224, PVA-405, PVA-420, PVA-613, L-8 and the like made by Kuraray Co., Ltd. Cited as copolymers of the above compounds are polyvinyl acetate chloroacetate or propionate, which is hydrolyzed at 88 to 100%, polyvinyl formal and polyvinyl acetal and their copolymers. Cited as other useful polymers are polyvinyl pyrrolidone, gelatin and gum arabic and these compounds may be used either singly or in the form of compounds combined with each other.

Although pure water is preferred as a solvent used when the overcoating layer is applied, it is also proper to mix alcohol such as methanol and ethanol, ketones such as methyl ethyl ketone and acetone into the pure water. Proper concentration of the solid content in a coating solution is 1 to 20 mass %.

In addition, it is also proper to add a surfactant for further improving coating property and publicly known additives such as water-soluble plasticizers for improving the physical properties of a layer to the overcoating layer. Cited as water-soluble plasticizers are for example propyonamide, cyclohexanediol, glycerin, sorbitol and the like. In addition, a water-soluble (meth)acrylic polymer and the like may be added.

Its proper coating weight after dried lies in a range of about 0.1 to about 15 g/m$^2$ and more preferably, 1.0 to about 5.0 g/m$^2$.

<Backcoat Layer>

Thus, the coating layer (hereinafter referred to as "a backcoat layer") composed of an organic high molecular compound can be provided on the back side of the presensitized plate according to the present invention that can be obtained by providing the image recording layer on the support for a lithographic printing plate according to the present invention in order to prevent the abrasion marks of image recording layers when presensitized plates are superimposed, as required.

Preferably used as the major component of a backcoat layer is at least one resin selected from a group consisting of saturated copolymer polyester resin, phenoxy resin, polyvinyl acetal resin and vinylidene chloride copolymer resin with a glass transition point of 20° C. or higher.

The saturated copolymer polyester resin includes dicarboxylic acid unit and diol unit. Cited as dicarboxylic acid units are aromatic dicarboxylic acids such as phthalic acid, terephthalic acid, isophthalic acid, tetrabromophthalic acid, tetrachlorophthalic acid; saturated aliphatic dicarboxylic acids such as adipic acid, azelaic acid, succinic acid, oxalic acid, suberic acid, sebacic acid, malonic acid, 1,4-cyclohexanedicarboxylic acid and the like.

Further, dyes, pigments and the like for coloring; silane coupling agent, diazo resin composed of diazonium salt, organic phosphonic acid, organic phosphoric acid, cationic polymer and the like for improving contact characteristics with the support for a lithographic printing plate; wax, higher fatty acid, higher fatty acid amide, silicone compound composed of dimethylcyclohexane, denatured dimethylcyclohexane and polyethylene powder normally used as slipping agents can be suitably contained in a backcoat layer.

The thickness of the backcoat layer may be to such an extent that the image recording layer is hardly scratched although an interleaving sheet is not provided basically and preferred is 0.01 to 8 μm. If the thickness is less than 0.01 μm or less, it is difficult to prevent the abrasion marks in image recording layers when the presensitized plate is superimposed for handling. If the thickness exceeds 8 μm, printing characteristics may deteriorate due to the variation of a printing pressure since the thickness of the backcoat layer varies with its swelling by a chemical used in the periphery of the lithographic printing plate during printing.

Various methods can be utilized to coat the back side of the presensitized plate with the backcoat layer. Cited for example are a method where each of the above components is dissolved in a solvent to prepare a suitable solution or to prepare an emulsified dispersing solution, which is spread and dried, a method where a backcoat layer which is preformed into a film is affixed with an adhesive or by heat, a method where a melted film is formed by a melting extruder and is affixed, and the like.

Among others, preferred to secure the above-described coating amount is a method where a solution is prepared and is spread and dried. For solvents organic solvents as described in JP 62-251739 A are used either singly or in the form of their mixture. As coating system or condition, many of systems for applying the image recording layer and the conditions can be utilized. Namely, a method using a coating rod, a method using an extrusion type coater and a method using a slide bead coater can be utilized for example.

The backcoat layer may be provided either before or after providing the image recording layer and the backcoat layer and the image recording layer may be simultaneously provided.

[Exposure and Developing Process]

A lithographic printing plate can be prepared by performing publicly known exposure and developing process on the presensitized plate according to the present invention.

It is preferred that the presensitized plate according to the present invention is exposed for a desired image by irradiating an infrared laser beam based on digital data and developing process is performed with a process using a normally used alkali developer.

In the process like this, if exposure and developing process are performed, a laser beam is efficiently absorbed by the infrared absorbent contained in the image recording layer of the exposure area, then only the image recording layer in the exposure area is allowed to generate heat by accumulating an absorbed energy due to the exposure, thereby generating acid. Acid causes the cross-linking agent coexistent to trigger a cross linking reaction, and while only the image recording layer in the exposure area is turned into alkali insoluble, the image recording layer of an unexposed area is removed by performing developing process using an alkali developer to form a desired image.

EXAMPLE

Although the present invention will be described in detail with reference to examples, the present invention is not limited to these examples.

1. Preparation of Support for a Lithographic Printing Plates (Support for a Lithographic Printing Plate [P-1])

<Aluminum Plate>

Molten metal was prepared by using an aluminum alloy containing Si: 0.06 wt %, Fe: 0.30 wt %, Cu: 0.005 wt %, Mn: 0.001 wt %, Mg: 0.001 wt %, Zn: 0.001 wt % and Ti: 0.03 wt %, and containing Al and inevitable impurities for the remaining portion. After molten metal treatment and filtering were performed, an ingot having a thickness of 500 mm and a width of 1200 mm was made by a DC casting method. After the surface was chopped to have an average thickness of 10 mm with a surface chipper, the ingot was held at 550° C. for about 5 hours for soaking. When the temperature dropped to 400° C., the ingot was formed into a rolled plate having a thickness of 2.7 mm by using a hot rolling mill. Further, after the heat treatment was performed at 500° C. with a continuous annealing machine, the roller plate was finished into an aluminum plate having a thickness of 0.24 mm with cold rolling to obtain an aluminum plate of JIS 1050 material. This aluminum plate was processed to have a width of 1030 mm, and surface treatment described below was continuously carried out.

<Surface Treatment>

Various surface treatments of (b) to (j) mentioned below were continuously performed. Furthermore, a liquid squeezing was performed by a nip roller after each treatment and water washing.

(b) Alkali Etching Treatment

Etching treatment was performed on the aluminum plate obtained in the foregoing manner by spraying an aqueous solution containing 2.6 wt % of sodium hydroxide and 6.5 wt % of aluminum ion at a temperature of 70° C. and the aluminum plate was dissolved by 6 g/m$^2$. After that, washing was performed by spraying water.

(c) Desmutting Treatment

The aluminum plate was subjected to spray desmutting treatment in aqueous solution of nitric acid 1 wt % (containing 0.5 wt % of aluminum ions) at 30° C., and then washed by spraying water. For the aqueous solution of nitric acid used in the desmutting treatment, waste solution generated in a process of electrochemical graining treatment carried out by using an alternating current in an aqueous solution of nitric acid to be described later was utilized.

(d) Electrochemical Graining Treatment

Electrochemical graining treatment was continuously performed by using an alternating current voltage of 60 Hz. Electrolyte in this case was aqueous solution of nitric acid 10.5 g/L (containing 5 g/L of aluminum ion and 0.007 wt % of ammonium ion) at a temperature of 50° C. An alternating current supply waveform was like that shown in FIG. 2. With the time TP necessary for a current value to reach its peak from zero set as 0.8 msec, and duty ratio set at 1:1, and by using a trapezoidal wave, the electrochemical graining treatment was performed while a carbon electrode was set as a counter electrode. A ferrite was used for an auxiliary anode. An electrolytic cell used is shown in FIG. 3.

The current density was 30 A/dm$^2$ at a current peak value. The total of the quantity of electricity was 220 C/dm$^2$ when the aluminum plate was at the anode side. An amount equivalent to 5% of a current flowing from the power supply was shunted to an auxiliary anode.

The aluminum plate was then washed by spraying water.

(e) Alkali Etching Treatment

Etching treatment was performed on an aluminum plate by spraying an aqueous solution containing 26 wt % of sodium hydroxide and 6.5 wt % of aluminum ion at 32° C. The aluminum plate was dissolved by 0.25 g/m$^2$, a smut component mainly containing aluminum hydroxide generated in the previous stage of the electrochemical graining treatment performed by using alternating current was removed, and edge portions of formed pits were dissolved to be made smooth. Then, the aluminum plate was washed by spraying water.

(f) Desmutting Treatment

The aluminum plate was subjected to spray desmutting treatment in aqueous solution of nitric acid 15 wt % (containing 4.5 wt % of aluminum ions) at 30° C., and then washed by spraying water. For the aqueous solution of nitric acid used in the desmutting treatment, waste solution generated in the process of the electrochemical graining treatment carried out by using an alternating current of a nitric acid was utilized.

(g) Electrochemical Graining Treatment

Electrochemical graining treatment was continuously performed by using an alternating current voltage of 60 Hz. Electrolyte in this case was aqueous solution of hydrochloric acid 7.5 g/L (containing 5 g/L of aluminum ion) at a temperature of 35° C. An alternating current supply waveform was like that shown in FIG. 2. With the time TP necessary for a current value to reach its peak from zero set as 0.8 msec, and duty ratio set at 1:1, and by using a trapezoidal wave, the electrochemical graining treatment was performed while a carbon electrode was set as a counter electrode. A ferrite was used for an auxiliary anode. An electrolytic cell used is shown in FIG. 3.

The current density was 25 A/dm$^2$ at a current peak value. The total of the quantity of electricity was 50 C/dm$^2$ when the aluminum plate was at the anode side.

Then, the aluminum plate was washed by spraying water.

(h) Alkali Etching Treatment

Etching treatment was performed on an aluminum plate by spraying an aqueous solution containing 26 wt % of sodium hydroxide and 6.5 wt % of aluminum ion at 32° C. The aluminum plate was dissolved by 0.10 g/m$^2$, a smut component mainly containing aluminum hydroxide generated in the previous stage of the electrochemical graining treatment performed by using alternating current was removed, and edge portions of formed pits were dissolved to be made smooth. Then, the aluminum plate was washed by spraying water.

(i) Desmutting Treatment

The aluminum plate was subjected to spray desmutting treatment in aqueous solution of sulfuric acid 25 wt % (containing 0.5 wt % of aluminum ions) at 60° C., and then washed by spraying water.

(j) Anodizing Treatment

By using anodizing device with a structure shown in FIG. 4, anodizing treatment was carried out. Accordingly, a support for a lithographic printing plate according to [P-1] was obtained. Electrolyte supplied for each of first and second electrolytic portions was sulfuric acid. For each electrolyte, the concentration of sulfuric acid was 170 g/L (containing 0.5 wt % of aluminum ion) at a temperature of 38° C. Then, washing by spraying water was carried out. The final amount of an anodized layer was 2.7 g/m$^2$.

(Support for a Lithographic Printing Plate [P-2])

A support for a lithographic printing plate according to [P-2] was obtained with the same method as in [P-1], except that the amount of the aluminum plate dissolved was 0.5 g/m$^2$ in (h) mentioned above.

(Support for a Lithographic Printing Plate [P-3])

A support for a lithographic printing plate according to [P-3] was obtained with the same method as in [P-1], except that the frequency of an alternating current voltage was set at 300 Hz in (g) mentioned above.

(Support for a Lithographic Printing Plate [P-4])

A support for a lithographic printing plate according to [P-4] was obtained with the same method as in [P-1], except that the current density was set 15 A/dm$^2$ at a current peak value in (d) mentioned above.

(Support for a Lithographic Printing Plate [P-5])

A support for a lithographic printing plate according to [P-5] was obtained with the same method as in [P-1], except that (a) to be mentioned below was performed before (b) mentioned above.

(a) Mechanical Graining Treatment

Mechanical graining treatment was carried out by rotating roller nylon brushes while supplying suspension containing abrasive (pumice) and water (specific gravity: 1.12) as abrasive slurry liquid to the surface of the aluminum plate, using device shown in FIG. 1. In FIG. 1, 1 represents an aluminum plate, 2 and 4 represent roller brushes, 3 represents an abrasive slurry liquid, and 5, 6, 7 and 8 represent supporting rollers. The abrasive had average particle size of 40 $\mu$m and the maximum particle size of 100 $\mu$m. A material for the nylon brush was 6·10 nylon, having a bristle length of 50 mm, and a bristle diameter of 0.3 mm. The Nylon brush was made by boring holes in a $\phi$300 mm stainless cylinder and densely implanting bristles therein. Three of such rotary brushes were prepared. Each distance between two supporting rollers ($\phi$200 mm) in the lower part of the brush was 300 mm. Each brush roller was pressed until a load of a driving motor for rotating the brush reached plus 7 kW with respect to the load before the brush roller was pressed to the aluminum plate. The rotating direction of each brush was the same as the moving direction of the aluminum plate. The number of rotations of the brushes was 200 rpm.

(Support for a Lithographic Printing Plate [P-6])

A support for a lithographic printing plate according to [P-6] was obtained with the same method as in [P-5], except that an abrasive was silica sand in (a) mentioned above.

(Support for a Lithographic Printing Plate [P-7])

A support for a lithographic printing plate according to [P-7] was obtained with the same method as in [P-5], except that the number of rotations of the brushes was 100 rpm in (a) mentioned above.

(Support for a Lithographic Printing Plate [R-1])

A support for a lithographic printing plate according to [R-1] was obtained with the same method as in [P-1], except that the frequency of alternating current voltage was set at 15 Hz in (d) mentioned above.

(Support for a Lithographic Printing Plate [R-2])

A support for a lithographic printing plate according to [R-2] was obtained with the same method as in [P-1], except that the temperature of an electrolyte was set at 80° C. and TP was set at 0 msec. in (d) mentioned above.

(Support for a Lithographic Printing Plate [R-3])

A support for a lithographic printing plate according to [R-3] was obtained with the same method as in [P-5], except that (g), (h) and (i) mentioned above were not performed.

(Support for a Lithographic Printing Plate [R-4])

A support for a lithographic printing plate according to [R-4] was obtained with the same method as in [P-1], except that (d), (e) and (f) mentioned above were not performed, the total quantity of electricity when the aluminum plate was at the anode side was set at 500 C/dm$^2$ in (g) mentioned above, and the amount of the aluminum plate dissolved was set at 0.5 g/m$^2$ in (h) mentioned above.

2. Measurement of Surface Shape of a Support for a Lithographic Printing Plate

For concave portions of the surface of each of the supports for a lithographic printing plate obtained as mentioned above, measurement of the (1) to (4) as below were performed.

The results were shown in Table 1. Note that, "-" in the table 1 indicates that there was no concave portion in the corresponding wavelength.

(1) Average Aperture Diameter of a Grained Structure with Medium Undulation

The surface of the support was photographed at a magnification of 2,000 from right above with an SEM. Next, in SEM micrograph obtained, 50 pits of a grained structure with medium undulation (pits of medium undulation) in which circumferences of the pits were annularly connected were extracted, aperture diameters were determined by reading the diameters of the pits, and an average diameter aperture was calculated.

(2) Average Aperture Diameter of a Grained Structure with Small Undulation

The surface of the support for a lithographic printing plate was photographed at a magnification of 50,000 from right above with an SEM. In an SEM micrograph obtained, 50 pits of the grained structure with small undulation (pits of small undulation) were extracted, the aperture diameter was determined by reading the diameters of the pits and an average aperture diameter was calculated.

(3) Average of Ratio of Depth to the Aperture Diameter of a Grained Structure with Small Undulation The average of ratio of depth to aperture diameter of a grained structure with small undulation was obtained as follows. A broken-out section of the support was photographed at a magnification of 50,000 with a high resolution SEM. In an SEM micrograph obtained, 20 pits of small undulation with aperture diameter 0.3 $\mu$m or less were extracted, the ratios were obtained by reading the aperture diameters and depths, and an average ratio was calculated.

(4) Average Wavelength of a Grained Structure with Large Undulation

A two-dimensional roughness measurement was performed with a stylus type surface roughness gauge (sufcom576 made by Tokyo Seimitsu Co., Ltd.), a mean spacing of peaks Sm specified in ISO4287 was measured five times, and its mean value was determined to be an average wavelength. The two-dimensional roughness measurement was performed under the following conditions.

Cut off: 0.8 $\mu$m, gradient correction: FLAT-ML, measured length: 3 mm, depth magnification: 10,000, scanning speed: 0.3 mm/sec., and sensing pin diameter: 2 $\mu$m.

TABLE 1

| | Grain shape of support for lithographic printing plate | | | |
|---|---|---|---|---|
| | Grained structure with large undulation | Grained structure with medium undulation | Grained structure with small undulation | |
| Support for lithographic printing plate | Average wave-length ($\mu$m) | Average aperture diameter ($\mu$m) | Average aperture diameter ($\mu$m) | Average of depth/aperture diameter |
| P-1 | — | 1.4 | 0.14 | 0.46 |
| P-2 | — | 1.4 | 0.15 | 0.16 |

TABLE 1-continued

| | Grain shape of support for lithographic printing plate | | | |
|---|---|---|---|---|
| | Grained structure with large undulation | Grained structure with medium undulation | Grained structure with small undulation | |
| Support for lithographic printing plate | Average wave-length (μm) | Average aperture diameter (μm) | Average aperture diameter (μm) | Average of depth/aperture diameter |
| P-3 | — | 1.4 | 0.07 | 0.22 |
| P-4 | — | 3.5 | 0.14 | 0.46 |
| P-5 | 65 | 1.4 | 0.14 | 0.46 |
| P-6 | 37 | 3.5 | 0.14 | 0.46 |
| P-7 | 14 | 1.4 | 0.14 | 0.46 |
| R-1 | — | 5.6 | 0.14 | 0.46 |
| R-2 | — | 0.4 | 0.14 | 0.46 |
| R-3 | 70 | 1.6 | — | — |
| R-4 | 51 | — | 0.25 | 0.14 |

3. Preparation of Presensitized Plates

Each support for a lithographic printing plate obtained above was used to prepare a presensitized plate.

Example 1

The following thermosensitive layer (photopolymerizable-type layer) solution [A] was prepared, the support for a lithographic printing plate [P-1] was coated by using a wire bar, the coating was dried at 115° C. for 45 seconds with a hot-air drying equipment to obtain a presensitized plate according to Example 1. The spread amount after drying is about 1.2 g/m$^2$.

<Thermosensitive Layer Solution [A]>

| | |
|---|---|
| * Infrared absorbent [IR - 6] | 0.08 g |
| * Radical generator [IO - 6] | 0.30 g |
| * Dipentaerythritolhexaacrylate | 1.0 g |
| * Copolymer of allylmethacrylate and methacrylic acid at mole ratio: 80:20 (weight average molecular weight 120,000, Binder Polymer) | 1.0 g |
| * Naphtalenesulfonate of Victoria pure blue | 0.04 g |
| * Fluorine-containing surfactant (Megafac F-176 made by Dainippon Ink And Chemicals, Incorporated) | 0.01 g |
| * Methyl ethyl ketone | 9.0 g |
| * Methanol | 10.0 g |
| * 1-methoxy-2-propanol | 4.0 g |
| * 3-methoxy-1-propanol | 4.0 g |

IR-6

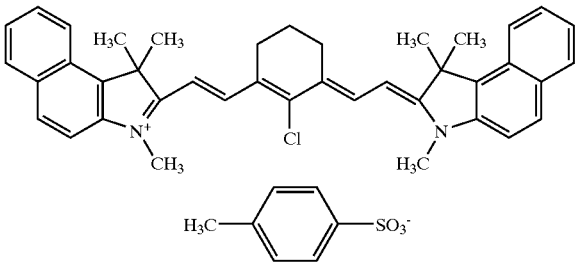

-continued

IO-6

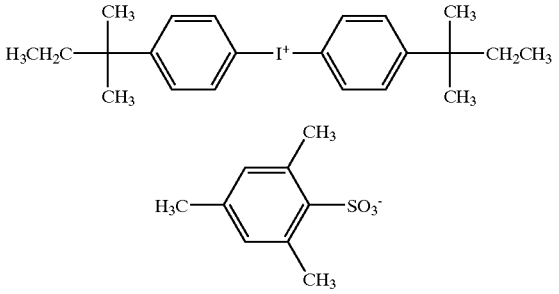

Example 2

A presensitized plate according to Example 2 was obtained with the same method as in Example 1, except that the support for a lithographic printing plate [P-2] was used.

Example 3

A presensitized plate according to Example 3 was obtained with the same method as in Example 1, except that the support for a lithographic printing plate [P-3] was used.

Example 4

A presensitized plate according to Example 4 was obtained with the same method as in Example 1, except that the support for a lithographic printing plate [P-4] was used.

Example 5

A presensitized plate according to Example 5 was obtained with the same method as in Example 1, except that the infrared absorbent [IR-6] of the thermosensitive layer solution [A] in Example 1 was replaced by an infrared absorbent [IR-7] in a thermosensitive layer solution [B] described below.

Example 6

A presensitized plate according to Example 6 was obtained with the same method as in Example 1, except that the support for a lithographic printing plate [P-5] was used.

Example 7

The infrared absorbent [IR-7] and a radical generator [IO-7] were used in the thermosensitive layer solution [A] of Example 1 to prepare the thermosensitive layer solution [B], which was then applied to the support for a lithographic printing plate [P-6]. The thus formed thermosensitive layer was further coated with aqueous solution of 3 wt % polyvinyl alcohol (saponification degree: 98 mol %; degree of polymerization: 500) to a dry coating weight of 2.5 g/m$^2$. The coating was dried at 120° C. for 3 minutes to obtain a presensitized plate according to Example 7.

IR-7

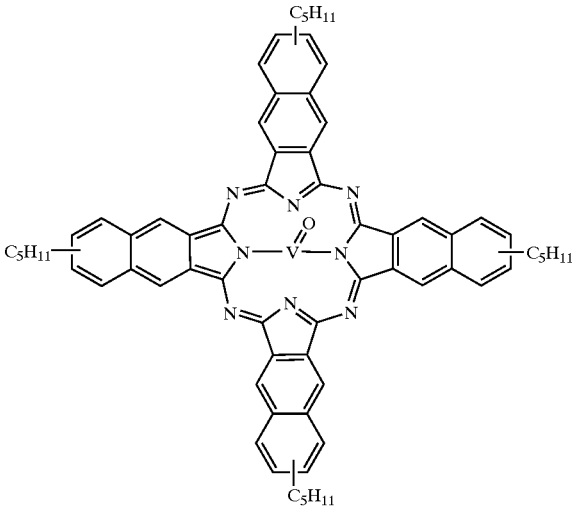

IO-7

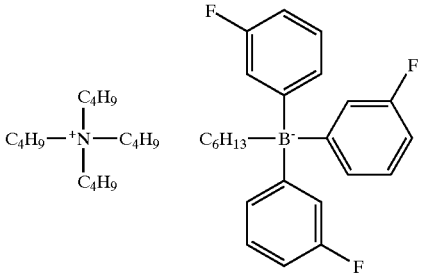

Example 8

An infrared absorbent [IR-8] and a radical generator [IO-8] were used in the thermosensitive layer solution [A] of Example 1 to prepare a thermosensitive layer solution [C], which was then applied to the support for a lithographic printing plate [P-7]. The thus formed thermosensitive layer was further coated with aqueous solution of 3 wt % polyvinyl alcohol (saponification degree: 98 mol %; degree of polymerization: 500) to a dry coating weight of 2.5 g/m$^2$. The coating was dried at 120° C. for 3 minutes to obtain a presensitized plate according to Example 8.

IR-8

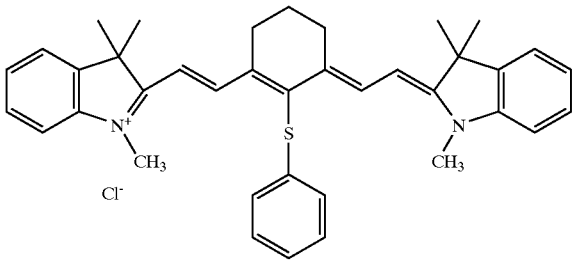

-continued

IO-8

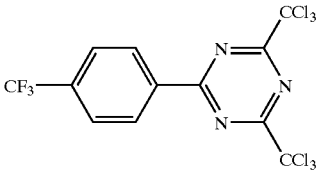

Example 17

The binder polymer BP-1, an infrared absorbent [IR-9] and a radical generator [IO-9] were used in the thermosensitive layer solution [A] of Example 1 to prepare the thermosensitive layer solution [E], which was then applied to the support for a lithographic printing plate [P-1]. The thus formed thermosensitive layer was further coated with aqueous solution of 3 wt % polyvinyl alcohol (saponification degree: 98 mol %; degree of polymerization: 500) to a dry coating weight of 2.5 g/m$^2$. The coating was dried at 120° C. for 3 minutes to obtain a presensitized plate according to Example 17.

IR-9

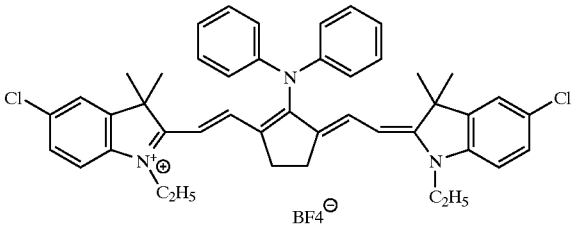

IO-9

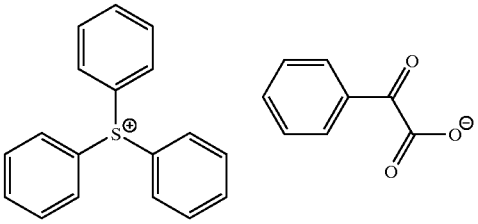

BP-1

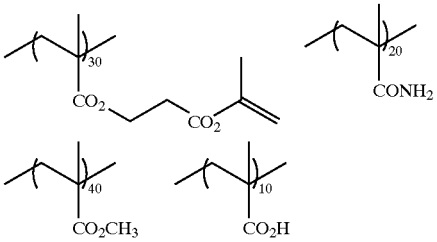

<Synthesis of Binder Polymer (BP-1)>

In a 1000-ml three-necked flask was placed 70 g of N,N-dimethylacetamide and heated to 70° C. in a nitrogen gas stream. To the solution was dropwise added a solution of 33.5 g of Compound (A-1) shown below, 6.8 g of methacrylamide, 12.0 g of methyl methacrylate, 6.9 g of methacrylic acid and 0.538 g of V-59 (produced by Wako Pure Chemical Industries, Ltd.) in 70 g of N,N-dimethylacetamide over a period of 2.5 hours. After the completion of the dropwise addition, the solution was heated to 90° C. and then stirred for 2 hours. The reaction solution was cooled to room temperature and poured into 3.5 liters of water to precipitate a polymer compound. The polymer compound precipitated was collected by filtration, washed with water and dried to obtain 48.5 g of the polymer compound. A weight average molecular weight of the polymer compound was measured by gel permeation chromatography (GPC) using a polystyrene standard. The weight average molecular weight thereof was 124,000. An acid value of the polymer compound determined by titration was 1.30 meq/g (calculated value: 1.35 meq/g), and it was confirmed that the polymerization had been normally conducted.

In a 200-ml three-necked flask were placed 26.0 g of the resulting polymer compound and 0.1 g of p-methoxyphenol, and they were dissolved in 60 g of N,N-dimethylacetamide. The resulting solution was cooled on an ice bath. After the temperature of the solution reached 5° C. or less, 30.4 g of 1,8-diazabicyclo[5.4.0]-7-undecene (DBU) was added dropwise thereto with a dropping funnel over a period of one hour. After the completion of the dropwise addition, the ice bath was removed, and the solution was further stirred for 8 hours. The reaction solution was poured into 2 liters of water containing 17 ml of concentrated hydrochloric acid to precipitate a polymer compound. The polymer compound precipitated was collected by filtration, washed with water and dried to obtain 18.2 g of Binder Polymer (BP-1).

The H-NMR of the polymer compound obtained was measured. As a result, it was confirmed that all of the side chain groups resulting from Compound (A-1) were converted to methacryloyloxyethyl groups. A weight average molecular weight of the polymer compound measured by gel permeation chromatography (GPC) using a polystyrene standard was 114,000. An acid value of the polymer compound determined by titration was 0.9 meq/g (calculated value: 0.8 meq/g).

Compound (A-1)

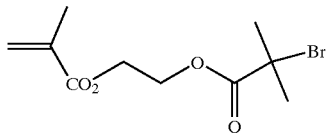

Comparative Example 1

A presensitized plate according to Comparative Example 1 was obtained with the same method as in Example 1, except that the support for a lithographic printing plate [R-1] was used.

Comparative Example 2

A presensitized plate according to Comparative Example 2 was obtained with the same method as in Example 7, except that the support for a lithographic printing plate [R-1] was used.

Comparative Example 3

A presensitized plate according to Comparative Example 3 was obtained with the same method as in Example 1, except that the support for a lithographic printing plate [R-2] was used.

Comparative Example 4

A presensitized plate according to Comparative Example 4 was obtained with the same method as in Example 8, except that the support for a lithographic printing plate [R-2] was used.

Comparative Example 5

A presensitized plate according to Comparative Example 5 was obtained with the same method as in Example 1, except that the support for a lithographic printing plate [R-3] was used.

Comparative Example 6

A presensitized plate according to Comparative Example 6 was obtained with the same method as in Example 1, except that the support for a lithographic printing plate [R-4] was used.

Comparative Example 13

A presensitized plate according to Comparative Example 13 was obtained with the same method as in Example 17, except that the support for a lithographic printing plate [R-1] was used.

[Exposure]

Exposure was performed on the obtained negative type presensitized plates, [Example 1] to [Example 8] and [Comparative Example 1] to [Comparative Example 6] under the conditions of output 9W, external drum speed 210 r.p.m., printing plate energy 100 mJ/cm$^2$ and resolution 2,400 dpi with Trendsetter 3244 VFS made by Creo Inc. with water-cooling type 40W infrared semiconductor laser mounted.

[Developing Process]

After exposure, developing process was performed with Automatic Developing Machine Stablon 900N made by Fuji Photo film Co., Ltd. A 1:1 water-diluted solution of DN-3C made by the company was used as a developer, the temperature of a developing bath was set at 30° C. and a 1:1 water-diluted solution of FN-6 made by the company is used as finisher.

Example 9

The following thermosensitive (acid cross-linkable-type layer) solution [D] was prepared, the support for a lithographic printing plate [P-1] was coated using a wire bar and was dried at 115° C. for 45 seconds with a hot-air drying equipment to obtain a presensitized plate according to Example 9. The spread amount after drying was 1.3 g/m$^2$.

<Thermosensitive Layer Solution [D]>

| | |
|---|---|
| Infrared absorbent [IR-6] | 0.07 g |
| Acid generator [SH-1] | 0.3 g |
| Cross-linking agent [KZ-9] | 0.5 g |
| Alkali-soluble high molecular compound (MARUKA LYNCUR M S-4P made by Maruzen Petrochemical CO., LTD.) | 1.5 g |
| Naphtalenesulfonate of Victoria pure blue (made by Hodogaya Co., Ltd.) | 0.035 g |
| Fluorine-containing surfactant (Megafac F-177 made by Dainippon Ink And Chemicals, Incorporated) | 0.01 g |
| Phthalic anhydride | 0.05 g |
| Methyl ethyl ketone | 12 g |

-continued

| | |
|---|---|
| Methyl alcohol | 10 g |
| 1-methoxy-2-propanol | 4 g |
| 3-methoxy-1-propanol | 4 g |

KZ-9

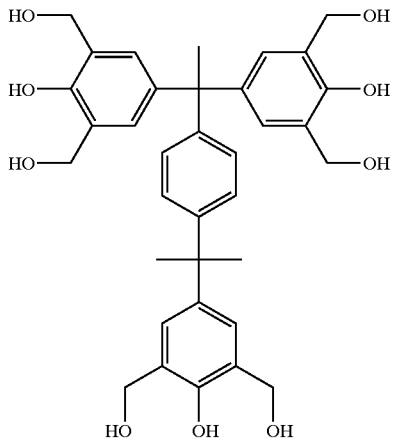

[SH-1]

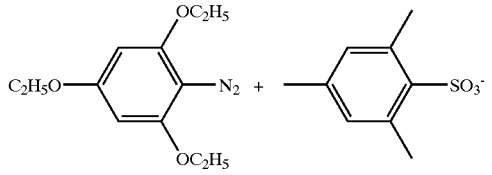

Example 10

A presensitized plate according to Example 10 was obtained with the same method as in Example 9, except that the support for a lithographic printing plate [P-2] was used.

Example 11

A presensitized plate according to Example 11 was obtained with the same method as in Example 9, except that the support for a lithographic printing plate [P-3] was used.

Example 12

A presensitized plate according to Example 12 was obtained with the same method as in Example 9, except that the support for a lithographic printing plate [P-1] and the acid generator [SH-1] in Example 9 were replaced by the support [P-4] and the radical generator [IO-8] in the thermosensitive layer solution [C], respectively.

Example 13

A presensitized plate according to Example 13 was obtained with the same method as in Example 9, except that the infrared absorbent [IR-6] and the acid generator [SH-1] of the thermosensitive layer solution [D] in Example 9 were replaced by the infrared absorbent [IR-7] in the thermosensitive layer solution [B] and the acid generator [IO-8], respectively.

Example 14

A presensitized plate according to Example 14 was obtained with the same method as in Example 9, except that the support for a lithographic printing plate [P-5] was used.

Example 15

A presensitized plate according to Example 15 was obtained with the same method as in Example 9, except that the support for a lithographic printing plate [P-1] and the infrared absorbent [IR-6] of the thermosensitive layer solution [D] in Example 9 were replaced by the support [P- 6] and the infrared absorbent [IR-7], respectively.

Example 16

A presensitized plate according to Example 16 was obtained with the same method as in Example 9, except that the support for a lithographic printing plate [P-1] and the infrared absorbent [IR-6] of the thermosensitive layer solution [D] in Example 9 were replaced by the support [P-7] and the infrared absorbent [IR-8] of the thermosensitive layer solution [C], respectively.

Comparative Example 7

A presensitized plate according to Comparative Example 7 was obtained with the same method as in Example 9, except that the support for a lithographic printing plate [R-1] was used.

Comparative Example 8

A presensitized plate according to Comparative Example 8 was obtained with the same method as in Example 9, except that the support for a lithographic printing plate [P-1] and the infrared absorbent [IR-6] of the thermosensitive layer solution [D] in Example 9 were replaced by the support [R-1] and the infrared absorbent [IR-7].

Comparative Example 9

A presensitized plate according to Comparative Example 9 was obtained with the same method as in Example 9, except that the support for a lithographic printing plate [P-1] and the acid generator [SH-1] of the thermosensitive layer solution [D] in Example 9 were replaced by the support [R-2] and the radical generator [IO-8], respectively.

Comparative Example 10

A presensitized plate according to Comparative Example 10 was obtained with the same method as in Example 9, except that the support for a lithographic printing plate [P-1], and the infrared absorbent [IR-6] and the acid generator [SH-1] of the thermosensitive layer solution [D] in Example 9 were replaced by the support [R-2], the infrared absorbent [IR-8] and the radical generator [IO-8], respectively.

Comparative Example 11

A presensitized plate according to Comparative Example 11 was obtained with the same method as in Example 9, except that the support for a lithographic printing plate [R-3] was used.

Comparative Example 12

A presensitized plate according to Comparative Example 12 was obtained with the same method as in Example 9, except that the support for a lithographic printing plate [R-4] was used.

[Exposure]

Exposure was performed on the obtained negative type presensitized plates, [Example 9] to [Example 16] and [Comparative Example 7] to [Comparative Example 12] under the conditions of output 9W, external drum speed 210 r.p.m., printing plate energy 100 mJ/cm$^2$ and resolution 2,400 dpi with Trendsetter 3244 VFS made by Creo Inc. with water-cooling type 40W infrared semiconductor laser mounted. After exposure, developing process was performed on a plate, on which heat treatment has been performed under the following conditions at 288° F. for 75 seconds with an oven made by Wisconsin Oven Corporation.

[Developing Process]

After exposure, developing process was performed with Automatic Developing Machine LP940H made by Fuji Photo film Co., Ltd. A developer used a 1:8 water-diluted solution of DP-4 made by the company, the temperature of a developing bath was set at 30° C. and finisher used a 1:1 water-diluted solution of FP-2W made by the company.

5. Evaluation of Lithographic Printing Plate

The inventors have evaluated the sensitivities of the lithographic printing plates obtained above, whether or not residual layers are generated, and the contact characteristic between the image recording layer and the support with the following methods.

(1) Sensitivity

Exposure is performed on thermal negative type presensitized plates according to Examples 1 to 16 and Comparative Examples 1 to 12 with Trendsetter 3244 VFS made by Creo Inc. with water-cooling type 40W infrared semiconductor laser mounted outputting under the condition of resolution 2,400 dpi. In this case, the inventors have evaluated the sensitivity from the minimum exposure value at which an image can be formed by allowing a printing plate energy to be changed by changing an exposure power (W) and an external drum revolution. The results are shown in Tables 2 and 3.

Note that the smaller the value of an exposure amount (printing plate energy), the higher the sensitivity, whereas the higher the value of the exposure amount, the lower the sensitivity.

(2) Whether or not Residual Layers Generated

The inventors have observed the non-image areas after development of each sample exposed in the above sensitivity test at a magnification of 100 with an optical microscope to inspect whether or not there are specks in an area of 1 mm$^2$. The degree of generation of speck-like residual layers is evaluated according to the three grades of "◎", "○", "Δ" in order of superiority (no generation of residual layers). The results are shown in Tables 2 and 3.

(3) Contact Characteristics Between the Image Recording Layer and the Support

The inventors have evaluated the contact characteristics between the image recording layer and the support with press life.

The inventors have performed printing using the obtained lithographic printing plates with Printing Press Lithrone made by Komori Corporation. The ink GEOS-G(N) made by Dainippon Ink And Chemicals, Incorporated is used. The inventors have taken out a printed product every 5,000 sheets, visually inspected the printed products and compared the number of good printed products with that of bad ones. The results are shown in Tables 2 and 3.

TABLE 2

| | Support for lithographic printing plate | Thermosensitive layer: Infrared absorbent | Thermosensitive layer: Radical generator | Sensitivity (mJ/cm$^2$) | Generation of residual layers | Press life (10,000 sheets) |
|---|---|---|---|---|---|---|
| | | | (No.1) | | | |
| Example 1 | P-1 | IR-6 | IO-6 | 60 | ○ | 6 |
| Example 2 | P-2 | IR-6 | IO-6 | 50 | ○ | 6 |
| Example 3 | P-3 | IR-6 | IO-6 | 60 | ○ | 6 |
| Example 4 | P-4 | IR-6 | IO-6 | 60 | ○ | 6 |
| Example 5 | P-1 | IR-7 | IO-6 | 50 | ○ | 6 |
| Example 6 | P-5 | IR-6 | IO-6 | 60 | ◎ | 5 |
| Example 7 | P-6 | IR-7 | IO-7 | 50 | ◎ | 5 |
| Example 8 | P-7 | IR-8 | IO-8 | 60 | ◎ | 5 |
| Example 17 | P-1 | IR-9 | IO-9 | 50 | ◎ | 7 |
| | | | (No. 2) | | | |
| Comparative Example 1 | R-1 | IR-6 | IO-6 | 70 | Δ | 3.5 |
| Comparative Example 2 | R-1 | IR-7 | IO-7 | 70 | Δ | 4 |
| Comparaive Example 3 | R-2 | IR-6 | IO-6 | 70 | ○ | 3.5 |
| Comparative Example 4 | R-2 | IR-8 | IO-8 | 70 | ○ | 3.5 |
| Comparative Example 5 | R-3 | IR-6 | IO-6 | 120 | ○ | 3.5 |
| Comparative Example 6 | R-4 | IR-6 | IO-6 | 180 | ○ | 1.5 |
| Comparative Example 13 | R-1 | IR-9 | IO-9 | 65 | Δ | 4.5 |

TABLE 3

| | Support for lithographic printing plate | Thermosensitive layer Infrared absorbent | Acid generator | Sensitivity (mJ/cm$^2$) | Generation of residual layers | Press life (10,000 sheets) |
|---|---|---|---|---|---|---|
| Example 9 | P-1 | IR-6 | SH-1 | 70 | ○ | 5 |
| Example 10 | P-2 | IR-6 | SH-1 | 70 | ○ | 5 |
| Example 11 | P-3 | IR-6 | SH-1 | 70 | ○ | 5 |
| Example 12 | P-4 | IR-6 | IO-8 | 70 | ○ | 5 |
| Exampel 13 | P-1 | IR-7 | IO-8 | 70 | ○ | 5 |
| Example 14 | P-5 | IR-6 | SH-1 | 70 | ◎ | 4.5 |
| Example 15 | P-6 | IR-7 | SH-1 | 70 | ◎ | 4.5 |
| Example 16 | P-7 | IR-8 | SH-1 | 70 | ◎ | 4.5 |
| Comparative Example 7 | R-1 | IR-6 | SH-1 | 80 | Δ | 3 |
| Comparative Example 8 | R-1 | IR-7 | SH-1 | 80 | Δ | 3 |
| Comparative Example 9 | R-2 | IR-6 | IO-8 | 80 | ○ | 3 |
| Comparative Example 10 | R-2 | IR-8 | IO-8 | 80 | ○ | 3 |
| Comparative Example 11 | R-3 | IR-6 | SH-1 | 140 | ○ | 3 |
| Comparative Example 12 | R-4 | IR-6 | SH-1 | 200 | ○ | 1.5 |

As is clear from Tables 2 and 3, it is found that for the presensitized plates (Examples 1 to 5, 9 to 13 and 6 to 8 and 14 to 16) according to the present invention using the supports for a lithographic printing plate ([P-1] to [P-4]) according to the present invention having on the surface thereof, a grain shape with a structure in which a grained structure with medium undulation with a specified aperture diameter and a grained structure with small undulation with a specified aperture diameter are superimposed and the supports for a lithographic printing plate ([P-5] to [P-7]) according to the present invention having on the surface thereof, a grain shape with a structure in which a grained structure with large undulation with a specified wavelength is further superimposed, the contact characteristics between the image recording layer and the support and scum resistance on the non-image area are kept compatible with each other at a high level, the sensitivity is excellent and a good image is formed. Particularly, it is found that the presensitized plates (Examples 6 to 8 and 14 to 16) according to the present invention using the supports for a lithographic printing plate ([P—S] to [P-7]) according to the present invention having on the surface thereof, a grain shape with a structure in which a grained structure with large undulation with a specified wavelength, a grained structure with medium undulation with a specified aperture diameter, and a grained structure with small undulation with a specified aperture diameter are superimposed are further excellent in scum resistance on the non-image area.

On the contrary, for the presensitized plates (Comparative Examples 1, 2, 7 and 8) using the support for a lithographic printing plate [R-1] in which a grained structure with medium undulation is of a large average aperture diameter, scum resistance and press life are poor since residual layers are generated. For the presensitized plates (Comparative Examples 3, 4, 9 and 10) using the support for a lithographic printing plate [R-2] in which a grained structure with medium undulation is of a small average aperture diameter, press life is poor. For the presensitized plates (Comparative Examples 6 and 16) using the support for a lithographic printing plate [R-4] in which a grained structure with small undulation is of a large average aperture diameter and a grained structure with medium undulation is not superimposed and the presensitized plates (Comparative Examples 5 and 11) using the support for a lithographic printing plate [R-3] in which a grained structure with small undulation with a specified aperture diameter is not superimposed, an image can not be formed at an exposure value of 100 mJ/cm$^2$.

The present invention can provide a high-sensitivity thermal negative type presensitized plate and the support for a lithographic printing plate used for the presensitized plate where the contact characteristics between the image recording layer and the support and the scum resistance on the non-image area are kept compatible with each other at a high level and a thermal diffusion depression effect by which an energy generated by exposure can be efficiently used to form an image is excellent.

What is claimed is:

1. A presensitized plate provided, on an aluminum support, with an image recording layer which is hardened by infrared rays, wherein said aluminum support has on the surface thereof, a grain shape in a structure in which a grained structure with medium undulation of 0.5 to 5 $\mu$m average aperture diameter and a grained structure with small undulation of 0.01 to 0.2 $\mu$m average aperture diameter are superimposed; and wherein said image recording layer is a photo polymerizable-type layer containing an infrared absorbent, a compound generating radicals by heating, and a radical polymerizable compound, or an acid cross-linkable-type layer containing an infrared absorbent, a compound generating acid by irradiating light or heating, and a crosslinking-agent acting in the presence of an acid.

2. The presensitized plate according to claim 1, wherein the average of ratios of depths to the aperture diameters of said grained structure with small undulation is 0.15 or more.

3. A presensitized plate provided, on an aluminum support, with an image recording layer which is hardened by infrared rays, wherein said aluminum support has on the surface thereof, a grain shape in a structure in which a grained structure with large undulation of 5 to 100 $\mu$m average wavelength, a grained structure with medium undulation of 0.5 to 5 $\mu$m average aperture diameter, and a grained structure with small undulation of 0.01 to 0.2 $\mu$m average aperture diameter are superimposed;

wherein said image recording layer is a photo polymerizable-type layer containing an infrared absorbent, a compound generating radicals by heating, and a radical polymerizable compound, or an acid cross-linkable-type layer containing an infrared absorbent, a compound generating acid by irradiating light or heating, and a cross-linking agent acting in the presence of an acid.

4. The presensitized plate according to claim 3, wherein the average of ratios of depths to the aperture diameters of said grained structure with small undulation is 0.15 or more.

* * * * *